US005138818A

United States Patent [19]

Humphrey

[11] Patent Number: 5,138,818

[45] Date of Patent: Aug. 18, 1992

[54] AUTOMATIC WRAPPING MACHINE AND METHOD OF WRAPPING

[75] Inventor: John R. Humphrey, Naples, Fla.

[73] Assignee: International Packaging Machines, Inc., Naples, Fla.

[21] Appl. No.: 710,834

[22] Filed: Jun. 5, 1991

[51] Int. Cl.[5] ..... B65B 11/04

[52] U.S. Cl. ..... 53/556; 53/587; 53/211

[58] Field of Search ..... 53/211, 441, 556, 587, 53/588, 389.4, 389.2

[56] References Cited

U.S. PATENT DOCUMENTS

| | | | |
|---|---|---|---|
| 4,077,179 | 3/1978 | Lancaster | 53/556 X |
| 4,204,377 | 5/1980 | Lancaster | 53/587 X |
| 4,235,062 | 11/1980 | Lancaster | 53/556 X |
| 4,271,657 | 6/1981 | Lancaster | 53/441 X |
| 4,282,700 | 8/1981 | Goldstein | 53/588 X |
| 4,432,185 | 2/1984 | Geisinger | 53/587 X |
| 4,563,863 | 1/1986 | Humphrey | 53/556 |

*Primary Examiner*—John Sipos
*Attorney, Agent, or Firm*—Antonelli, Terry, Stout & Kraus

[57] ABSTRACT

A wrapping machine (10) which retains a gathered leading edge of a wrapping material with a clamp (40) by a rotatable turntable (14) supporting a load (16) during at least initiation of wrapping of the load with the wrapping material in accordance with the invention including at least one wrapping material retaining mechanism (42, 44, 300), a wrapping material retaining mechanism being movable from a first position to a second position, the at least one wrapping material retaining mechanism in the second position retaining the wrapping material without gathering of the wrapping material; a wrapping material translating mechanism (52, 53, 55, 55', 57 or 300-316) carried by one of the at least one wrapping material retaining mechanism for translating the wrapping material retained by the at least one wrapping material retaining mechanism into the clamp to gather wrapping material within the clamp while the clamp is in an open position for retention of the gathered wrapping material when the clamp is closed; and a controller (400) for controlling the movement of the at least one wrapping material retaining mechanism between the first and second positions, the wrapping material translating mechanism to translate the wrapping material into the open clamp and the closing of the clamp to retain the gathered wrapping material.

71 Claims, 19 Drawing Sheets

AUTOMATIC WRAPPING MACHINE AND METHOD OF WRAPPING

TECHNICAL FIELD

The present invention relates to a method and apparatus for automatically wrapping a load disposed on a turntable with a stretchable wrapping material for the purpose of unitizing the load.

BACKGROUND ART

Stretch wrapping machines are commercially available which automatically wrap a load disposed on a rotatable turntable with a stretchable wrapping material. These machines may be fully automatic, including conveying of the load to and from the turntable by an automated conveyor system or by the use of a lifting device, such as a forklift, which places individual loads on the turntable where fully automated wrapping is performed. Automatic stretch wrapping machines are characterized by a high throughput with an increase in the throughput, lowering of consumption of stretchable wrapping material and a decrease in wrapping time being design goals required for the wrapping of individual loads. Automatic stretch wrapping machines may wrap the load on the turntable with a stretchable wrapping material having a width equal to or greater than the height of the load being wrapped with several turns of the stretchable wrapping material or with a stretchable wrapping material having a width less than the height of the load being wrapped by vertically translating the wrapping material with respect to the height of the load to spirally wrap the load with multiple turns of the stretchable wrapping material.

In an automatic stretch wrapping machine, it is necessary to attach a leading edge of the wrapping material to the load being wrapped during the wrapping cycle and to sever the trailing edge from the supply of stretchable wrapping material and attach the trailing edge of the wrapping material to the load prior to removal from the turntable. The prior art has utilized a number of different techniques for attaching the leading and trailing edges of the wrapping material to the load.

The leading edge of the wrapping material may be gathered into a rope and clamped by a clamp carried by the rotating turntable to retain the wrapping material during initiation of the wrapping cycle. Examples of automatic stretch wrapping machines utilizing this technique are disclosed in U.S. Pat. Nos. 4,271,659, 4,300,326, 4,302,920, 4,432,185, 4,563,863, which is assigned to the Assignee of the present application, and 4,619,102.

U.S. Pat. Nos. 4,077,179, 4,216,640 and 4,235,062 disclose the retaining of the leading edge of the wrapping material during the initiation of the wrapping cycle without roping by clamping ungathered wrapping material. Clamping mechanisms for the wrapping material which do not utilize roping have the disadvantage that the thinness of the wrapping material makes it difficult for the initiation of wrapping to be started under full tension as consequence of the propensity of the thin wrapping material to slip under high applied tension between the jaws of a clamp. Furthermore, the unroped wrapping material is subject to tearing from the grip of the clamp which can cause automatic wrapping of a load to fail requiring reclamping of the wrapping material.

Mechanisms for attaching the trailing edge of the wrapping material to the load at the end of the wrapping cycle include heat sealing of the stretchable wrapping material to the load and the brushing of the full width of the stretchable wrapping material or a gathered width against the load with reliance being placed upon static attraction of the trailing edge to an underlying wrap of the wrapping material. The Assignee's U.S. Pat. No. 4,563,863 discloses the use of a brush for brushing the trailing edge of the wrapping material against the load to secure the gathered trailing edge to an underlying wrap of the material. The assignee's Model 8200AX and 8200CAX automatic stretch wrapping machines include sensors for detecting oversized loads and the height of the load which may be erroneously tripped by a loose trailing edge which can cause a shutdown of wrapping. Shutdowns which require a resetting of the system reduce the efficiency of wrapping and the throughput.

Stretch wrapping machines which rely upon gathering of the full width of the stretchable wrapping material into a rope to clamp the leading edge are limited in the width of the stretchable wrapping material which may be used. As the width of the stretchable wrapping material becomes greater, the diameter of the rope becomes so great that it is not possible to effectively clamp the rope. The center portion of a large diameter rope can pull out from the clamp. In commercially available automatic stretch wrapping machines, it becomes extremely difficult to utilize wrapping material widths greater than a dimension such as 30 inches which rely upon gathering for retention in a clamping mechanism for initiating of wrapping. Furthermore, the Assignee of the present invention has found that its Models 8200CAX and 8200AX, which are in accordance with U.S. Pat. No. 4,563,863, have difficulty gathering wide widths of stretch wrapping material, such as those above 30 inches.

In the Assignee's Models 8200CAX and 8200AX when a wide width of stretchable wrapping material is used, the top edge of the stretch wrapping material is placed under high tension as a consequence of a gathering arm being rotated downward to pull the wrapping material into the clamp carried by the turntable. The loading of high tension on top of the stretchable wrapping material causes the wrapping material at the bottom edge of the width of the wrapping material to be loose or under little tension. The loose stretchable wrapping material may not be completely retained by the clamp when the loose wrapping material is forced into the clamp by the gathering arm. An unclamped loose leading edge of the stretchable wrapping material can interfere with placing full wrapping tension on the load at the beginning of the wrapping cycle. Loose stretchable wrapping material can cause the load size sensors to be tripped erroneously. Additionally, the application of high tension to the top edge of the stretchable wrapping material may cause the stretchable wrapping material feeding mechanism, such as that manufactured in accordance with U.S. Pat. Nos. 4,706,443, 4,590,746 and 4,862,678, which are assigned to the Assignee of the present invention, to be activated to react to the application of high tension to the top edge of the wrapping material to play out additional wrapping material further loosening the bottom edge.

Additionally, cutting of a rope formed by gathering a width of stretchable wrapping material greater than, for example, 30 inches can result in incomplete severing of the full width when the rope is not completely retained within the clamp which results in the stretchable wrapping material being retained by both the clamping mechanism carried by the turntable and to the load which has been wrapped. This condition requires manual intervention for correction which lowers throughput.

Finally, a large diameter rope is subject to being pulled loose from the clamp during initiation of the wrapping cycle especially when an attempt is made to apply full tension to the stretchable wrapping material at the beginning of the stretch wrapping cycle. Pulling loose of a rope from a clamp at the beginning of the stretch wrapping cycle can require manual intervention to attach the loose leading edge which lowers throughput.

It is well known that spiral wrapping of stretchable wrapping material on a load requires an overlap between adjacent turns to be effective which may require three or more inches of wrapping material. As a result of the required overlap, additional stretchable wrapping material is required to wrap a load with a spiral wrap when compared to the stretchable wrapping material required to wrap the load with a wrapping material which is at least as wide as the height of the load. Accordingly, the overall cost of stretch wrapping could be substantially lessened by an automatic stretch wrapping machine having the ability to wrap loads with widths of stretchable wrapping material of wide widths such as greater than 30 inches without spiral wrapping. Stretchable wrapping material is currently available in widths up to 80 inches or more. Prior art automatic stretch wrapping machines which required the use of a spiral wrapping to wrap high profile loads cannot effectively use these greater widths of stretchable wrapping material for performing non-spiral wrapping. This prevents realization of the cost savings: set forth above consequent from non-spiral wrapping. Furthermore, the inability to use wide widths of stretchable wrapping material prevents a higher number of units from being wrapped in a given time period as a consequence of the turntable making a greater number of turns with spiral wrapping to complete the wrapping cycle.

DISCLOSURE OF INVENTION

The present invention is an automatic wrapping machine and method of wrapping a load disposed on a rotatable turntable with a wrapping material which preferably is stretchable and which may have widths greater than those utilized by prior art automatic wrapping machines. The invention utilizes the gathering of only a fraction of the width of the stretchable wrapping material within a clamp to secure the leading edge of the stretchable wrapping material during the initiation of the wrapping cycle when using wide widths of stretchable wrapping material for nonspiral wrapping. As a result, when stretchable wrapping materials of a wide width are utilized, the problems of the prior art of placing extreme tension on the upper edge of the stretchable wrapping material and having substantially no tension or loose stretchable wrapping material on the bottom edge of the stretchable wrapping material, pulling the stretchable wrapping material from the clamp retaining the stretchable wrapping material in an ungathered or gathered form and the inability of a clamp to hold a large diameter rope of the stretchable wrapping material are eliminated.

When the invention is used for non-spiral wrapping loads with wide widths of stretchable wrapping material which heretofore could not be used because of ineffective clamping of the leading edge, the quantity of stretchable wrapping material which is consumed is lessened, throughput of wrapped loads on a time basis is increased and an overall reduction in the cost of wrapping is achieved. Additionally, the present invention may also be used effectively for automatic spiral wrapping of loads.

With the invention, at least one wrapping material retaining mechanism retains the stretchable wrapping material without gathering the stretchable wrapping material and a wrapping material translating mechanism carried by a wrapping material retaining mechanism translates the stretchable wrapping material into an opened clamp where at least a fraction of the width of the stretchable wrapping material is gathered and clamped. For wide width stretchable wrapping materials, a fraction such as 25% to 75% of the width of the material is gathered. For stretchable wrapping materials of lesser width, such as those currently being used of up to 30 inches, the full width may be gathered. However, these lesser width stretchable wrapping materials may also have only a fraction of their width gathered. As a result, the overall diameter of the gathered material is not so large as to prevent effective clamping which precluded the roping of stretchable wrapping material of wide widths in the prior art.

Furthermore, gathering a fraction of the width of the stretchable wrapping material is sufficient to prevent slippage of the stretchable wrapping material from the jaws of the clamp during initiation of the stretch wrapping which permits full tension to be applied to the load during the initiation of stretch wrapping which provides the most economical stretch wrapping as a consequence of achieving maximum elongation of the stretchable wrapping material for the entire stretch wrapping operation which was prevented in the prior art where less than full tension could be placed on the stretchable wrapping material during the initiation of stretch wrapping as a consequence of the inability to effectively clamp the stretchable wrapping material.

With the invention, wide widths of stretchable wrapping material up to 80 inches or more may be utilized to wrap high profile loads without spiral wrapping which was often necessary in the prior art to wrap high profile loads.

The clamping of the stretchable wrapping material with at least one wrapping material retaining mechanism without gathering the stretchable wrapping material permits the trailing edge of the stretchable wrapping material to be heat sealed across the entire width of the stretchable wrapping material. As a result, the potential of looseness of the gathered trailing edge of the stretch wrapping material as with automatic stretch wrapping machines in accordance with Assignee's U.S. Pat. No. 4,563,863 and Models 8200AX and 8200CAX is eliminated.

An automatic wrapping machine in accordance with present invention includes a turntable having a surface for rotatably supporting a load to be wrapped with a wrapping material; a mechanism for providing wrapping material of a given width to be used to wrap a load disposed on the turntable, the load being wrapped with a section of wrapping material which is defined by a leading edge and a trailing edge; a mechanism for rotating a turntable to cause wrapping of the load with the wrapping material under tension during wrapping; at least one wrapping material retaining mechanism, the at least one wrapping material retaining mechanism being movable from a first position to a second position, the at least one wrapping material retaining mechanism in the second position retaining the wrapping material without gathering the wrapping material; a clamp, aligned with the at least one wrapping material retaining mechanism in the second position, mounted for rotation with the turntable, for clamping a gathered leading edge of the wrapping material during initiation of wrapping of the load to cause the wrapping material to be wrapped around the load without slippage as the turntable rotates and for clamping gathered wrapping material which becomes the gathered leading edge for wrapping a next load; a mechanism for opening and closing the clamp; a cutting mechanism for cutting the wrapping material; a wrapping material translating mechanism carried by one of the at least one wrapping material retaining mechanism for translating the wrapping material retained by the at least one wrapping material retaining mechanism into the open clamp to gather a portion of the wrapping material within the clamp for clamping when the clamp is closed; and a controller causing sequentially in time wrapping the load by activating the means for rotating the turntable and the means for providing wrapping material, the at least one wrapping material retaining mechanism to move to the second position to retain the wrapping material, activation of the cutting mechanism to cut the wrapping material to free the wrapping material from the load, activation of the wrapping material translating mechanism to translate the portion of the wrapping material into the clamp, to gather the portion of the material while leaving a remainder of the material not gathered closing the clamp to retain gathered wrapping material in the clamp and moving the at least one wrapping material holding mechanism to the first position. One or two wrapping material retaining mechanisms may retain the wrapping material at the second position. First and second wrapping material retaining mechanisms retain the wrapping material in the second position by contacting two sides of the wrapping material at opposed positions of the two sides of the wrapping material to clamp the wrapping material. One wrapping material retaining mechanism may retain the wrapping material at the second position by a vacuum clamp which holds a single side of the stretchable wrapping material.

The vacuum clamp comprises a belt having a plurality of apertures with a first side of the belt retaining the wrapping material when the one wrapping material retaining mechanism is in the second position; a vacuum plenum facing a second side of the belt; a vacuum source for applying vacuum to the plenum which is applied to the wrapping material through the apertures; and a motor for driving the belt to translate the retained wrapping material into the opened clamp.

The first wrapping material retaining mechanism has at least one driven element which may be a wheel or belt contacting the wrapping material across at least a fraction of the given width when the first wrapping material retaining mechanism is in the second position; the second wrapping material retaining mechanism has at least one idler element which may be a wheel or belt contacting the wrapping material across at least a fraction of the given width when the second wrapping material retaining mechanism is in the second position; and a motor for driving the at least one driven element which translates the wrapping material into the opened clamp with the at least one idler element being driven by the translation of the wrapping material into the opened clamp. The first wrapping material retaining mechanism further comprises at least one idler roller in line with a direction of motion of the at least one driven element with the at least one idler roller each having a peripheral surface contacting the wrapping material when the first wrapping material retaining mechanism is in the second position and disposed within a plane containing a surface of the at least one driven element contacting the wrapping material; and the second wrapping material retaining mechanism further comprises at least one idler roller in line with a direction of motion of the at least one idler element with the at least one idler roller each having a peripheral surface contacting the wrapping material when the second wrapping material retaining mechanism is in the second position and disposed within a plane containing a surface of the at least one idler element contacting the wrapping material.

The one wrapping material retaining mechanism is mounted on a single arm and the first and second wrapping material retaining mechanisms are respectively mounted on first anely retained by the clamp when the loose wrapping material is forced into the clamp by the gathering arm. An unclamped loose leading edge can interfere with placing full wrapping tension on the load at the beginning of the wrapping cycle. Loose wrapping material can cause the load size sensors to be tripped erroneously. Additionally, the application of high tension to the top edge of the stretch wrapping material may cause the stretch wrapping material feeding mechanism, such as that manufactured in accoanslating mechanism to cause movement of the wrapping material by a distance which may be equal to the entire width of the wrapping material or equal to a fraction of the given width into the opened clamp to gather either the entire width or a fraction of the given width in the clamp for clamping. The gathered fraction may be equal to between 25% and 75% of the given width. The given width of the wrapping material may be at least as wide as the load and the controller causes the mechanism for rotating the turntable to wrap the load with multiple turns of wrapping material as wide as the load.

In a wrapping machine which retains a gathered leading edge of a wrapping material with a clamp carried by a rotatable turntable supporting a load during at least initiation of wrapping of the load with the wrapping material, an improvement in accordance with the invention includes at least one wrapping material retaining mechanism, the at least one wrapping material retaining mechanism being movable from a first position to a second position, the at least one wrapping material retaining mechanism in the second position retaining the wrapping material without gathering of the wrapping material; a wrapping material translating mechanism for translating the wrapping material retained by one of the at least one wrapping material retaining mechanism into the opened clamped to gather a portion of the wrapping material within the clamp while the clamp is in an open position for retention of the gathered wrapping material when the clamp is closed; and a controller for controlling the movement of the at least one wrapping material retaining mechanism between the first and second positions, the wrapping material translating mechanism to translate the portion of the wrapping material into the opened clamp to gather the portion of the material while leaving a remainder of the material not gathered and the closing of the clamp to retain the gathered wrapping material. Either one wrapping material retaining mechanism or first and second wrapping material retaining mechanisms retain the wrapping material at the second position. The first and second wrapping material retaining mechanisms retain the wrapping material in the second position by contacting two sides of the wrapping material at opposed positions of the two sides of the wrapping material to clamp the wrapping material. The one wrapping material retaining mechanism retains the wrapping material at the second extended position by a vacuum clamp.

The vacuum clamp comprises a belt having a plurality of apertures with a first side of the belt retaining the wrapping material when the one wrapping material retaining mechanism is in the second position; a vacuum plenum facing a second side of the belt; a vacuum source for applying vacuum to the plenum which is applied to the wrapping material through the apertures; and a motor for driving the belt to translate the retained wrapping material into the opened clamp.

The first wrapping material retaining mechanism has at least one driven element which may be a belt or wheel contacting the wrapping material across at least a fraction of the given width when the first wrapping material retaining mechanism is in the second position; the second wrapping material retaining mechanism has at least one idler element which may be a belt or a wheel contacting the wrapping material across at least a fraction of the given width when the second wrapping material retaining mechanism is in the second position; and a motor for driving the at least one driven element which translates the wrapping material into the open clamp with the idler element being driven by the translation of the wrapping material into the open clamp. The first wrapping material retaining mechanism further comprises at least one idler roller in line with a direction of motion of the driven element with the at least one idler roller each having a peripheral surface contacting the wrapping material when the first wrapping material retaining mechanism is in the second position and disposed within a plane containing a surface of the driven element contacting the wrapping material; and the second wrapping material retaining mechanism further comprises at least one idler roller in line with a direction of motion of the idler element with the at least one idler roller each having a peripheral surface contacting the wrapping material when the second wrapping material retaining mechanism is in the second position and disposed within a plane containing a surface of the idler element contacting the wrapping material. The first and second wrapping material retaining mechanisms are respectively mounted on first and second arms which rotate between first and second positions to move the first and second wrapping material retaining mechanisms between the first and second positions. An actuator is movable between first and second positions under the control of the controller for driving the first and second arms between the first and second positions.

The one wrapping material retaining mechanism is mounted on an arm which rotates between first and second positions to move the one wrapping material retaining mechanism between the first and second positions. An actuator is movable between first and second positions under the control of the controller for driving the arm between the first and second positions.

The controller controls the wrapping material translating mechanism to cause movement of the wrapping material by a distance equal to the given width of the wrapping material or equal to a fraction of the given width into the opened clamping mechanism to gather the given width or a fraction of the given width in the clamp. The gathered fraction may be equal to between 25% and 75% of the given width but is not limited thereto.

The given width of the wrapping material may be at least as wide as the load and the controller causes the mechanism for providing wrapping material and the mechanism for rotating the turntable to wrap the load with multiple turns of wrapping material as wide as the load.

A method wrapping a load with the wrapping material of a given width by rotation of a rotatable turntable supporting the load to wrap multiple turns of the wrapping material on the load in accordance with the invention comprises retaining the wrapping material in a plane without gathering the wrapping material; translating the wrapping material which has been retained without gathering into an open clamp to gather the wrapping material; clamping the gathered wrapping material with the clamp; and wrapping the load with the multiple turns of the wrapping material with the gathered wrapping material being retained during at least initiation of wrapping of the load. Either a fraction or the full width of the ungathered wrapping material may be translated into the clamp and gathered. The plane of the clamped wrapping material is parallel to an axis of rotation of the turntable.

BEST MODE FOR CARRYING OUT THE INVENTION

Figure 1:
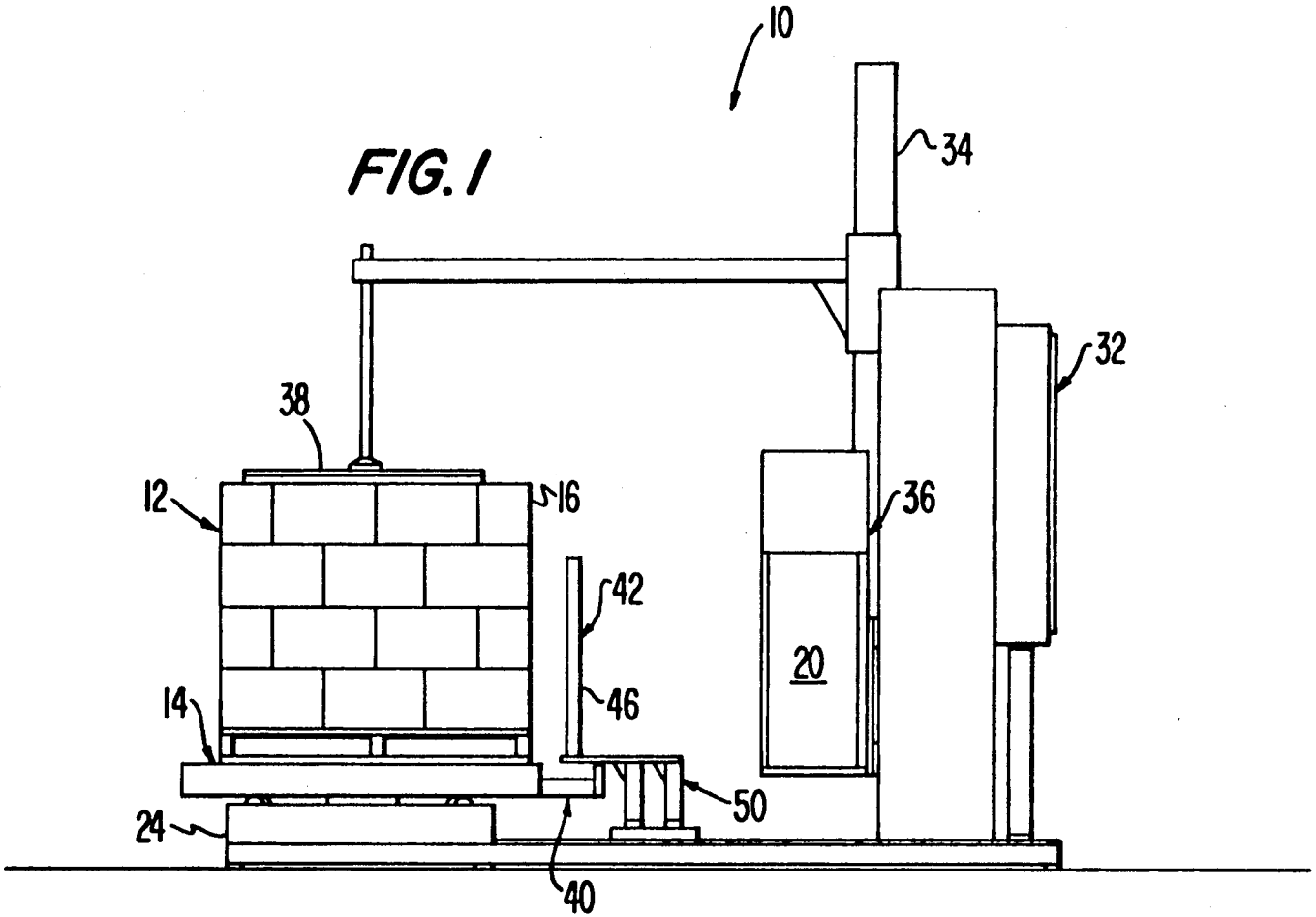
FIG. 1 illustrates a side elevational view of a first embodiment of the present invention.
Figure 2:
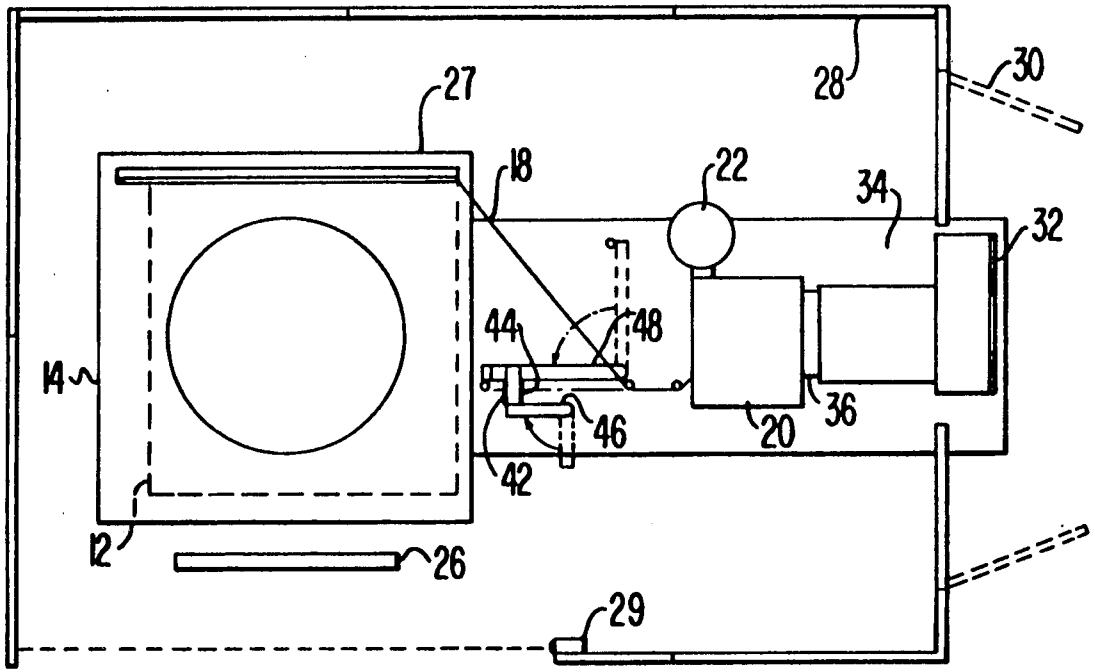
FIG. 2 illustrates a top plan view of the first embodiment of the present invention.

FIGS. 1 and 2 respectively illustrate a side elevational view and a top plan view of a first embodiment 10 of an automatic stretch wrapping machine in accordance with the present invention which stretch wraps a load 12 which is disposed upon a rotatable turntable 14 with a stretchable wrapping material 18 of any well-known type. The embodiment 10 may be used for automatic non-spiral stretch wrapping of loads with a high vertical profile of 80 or more inches without the problems of the prior art. The load typically is comprised of a plurality of separate items 16 which are to be unitized for shipping as is well known in the art. The stretchable wrapping material 18 is provided from a wrapping material source 20 which preferably produces prestretching of material pulled from a supply roll 22 past the yield point as is known in the prior art. The prestretching, which is optional in practicing the invention, may be in accordance with the U.S. Pat. Nos. 4,590,746, 4,706,443 and 4,862,678 but is not limited thereto. The turntable drive 24 contains a motor (element 404 of FIGS. 19 and 21) for rotating the turntable 14 under the control of a control program. It should be understood that the present invention is not limited to the use of any control program. Furthermore, while the invention is illustrated with a system for placing loads on the turntable by means of a forklift, it should be understood that the present invention may be practiced with an automatic conveyor system in accordance with that disclosed in the Assignee's U.S. Pat. No. 4,563,863. A forklift stop 26 provides a stop for forklifts which place the load 16 upon the turntable 14. A load stop 27 prevents the load 16 from slipping off of the rear of the turntable 16. The safety fence 28 surrounds the load. Photocell 29 detects if a forklift has entered the loading zone. Gates 30 with safety switches control access to the area set off by the safety fence 28. A control box 32 contains the controls for operating the automatic stretch wrapping machine. A tower 34 supports a film carriage 36 which translates the source of wrapping material 20 upward and downward to accomplish spiral wrapping if it is desired to spiral wrap the load 16 with wrapping material from the supply roll 22. The translation of the carriage 36 up and down the tower 34 to spiral wrap a load may be in accordance with the Assignee's Model 8200CAX and 8200AX machines. Optionally a top platen 38 may be provided to stabilize the load 16, but it should be understood that the present invention does not require the use of a top platen for wrapping loads having a high profile such as those greater than 30 inches without utilizing spiral wrapping.

The present invention, without limitation, performs automatic non-spiral stretch wrapping with stretchable wrapping material having a given width greater than 30 inches and up to 80 inches or more with the width being equal to or greater than the height of the load 16. These wide stretchable wrapping material widths utilize less wrapping material as a consequence of eliminating overlaps between adjacent turns of the wrap and applying full tension throughout the wrapping cycle and lessen the time for completing the wrapping cycle as a consequence of requiring fewer turns of the turntable 14 to complete wrapping.

The automatic stretch wrapping machine 10 is an improvement over the automatic stretch wrapping machine disclosed in the Assignee's U.S. Pat. No. 4,563,863 by providing a mechanism for effectively retaining a leading edge of the stretchable wrapping material in a film clamp 40 which is carried by the turntable 14 for stretchable wrapping material having wide widths such as widths greater than 30 inches. At least one and, as illustrated, a first wrapping material retaining mechanism 42 and a second wrapping material retaining mechanism 44 are respectively mounted on a first arm 46 and a second arm 48 which rotate respectively from a first position illustrated in phantom to the second position as illustrated for clamping the wrapping material 18 without gathering and reduction in width. After heat sealing of the trailing edge of the stretchable wrapping material 18 which is wrapped on the load 16 with a heat sealer discussed below in conjunction with FIGS. 3–6, and severing with a cutting mechanism discussed below in conjunction with FIGS. 3–8 to free the wrapped load from the wrapping material 18, all of or a fraction of the given width of the wrapping material retained by the wrapping material retaining mechanisms 42 and 44 or the single wrapping material retaining mechanisms 300 described below in conjunction with FIGS. 14–18 is translated into the opened clamp 40 to gather either all of or a fraction of the width of the stretchable wrapping material as is described below in detail.

For wrapping loads 12 with wide widths of stretchable wrapping material 18, the present invention may be used to gather only a fraction of the width of the stretchable wrapping material by translating only a fraction of the width of the stretchable wrapping material retained in the wrapping material retaining mechanisms 42 and 44 or the single wrapping material retaining mechanism 300 described below in conjunction with FIGS. 14–18 into the clamp 40 whereafter the clamp is closed to effectively retain the gathered stretchable wrapping material against slippage. By clamping only a fraction of the width of the stretchable wrapping material 18 in the clamp 40, it is possible to utilize stretchable wrapping material having a width greater than 30 inches with widths greater than 80 inches being usable without having the problems described above with the prior art consequent from trying to gather the full width of a wide width of stretchable wrapping material as in the prior art. By gathering only a fraction of the width of the stretchable wrapping material 18, the differential tension placed upon the top and bottom edges of the stretch wrapping material discussed above is avoided and further problems associated with attempting to clamp the large diameter rope produced by the gathering of a wide width of stretchable wrapping material are avoided as a consequence of reducing the diameter of the rope which is clamped by the clamp 40.

While a preferred mechanism for deploying the first and second wrapping material retaining mechanisms 42 and 44 is with arms 46 and 48, it should be understood that the present invention is not limited thereto and may be practiced with mechanism utilizing linear movement. A suitable actuator 50, which is described below in conjunction with FIGS. 3–6, controls the movement of the first and second wrapping material retaining mechanisms 42 and 44 between the first and second positions by rotating the arms 46 and 48 between the first and second positions under the control of the controller which may be under the control of the control program.

Figure 3:
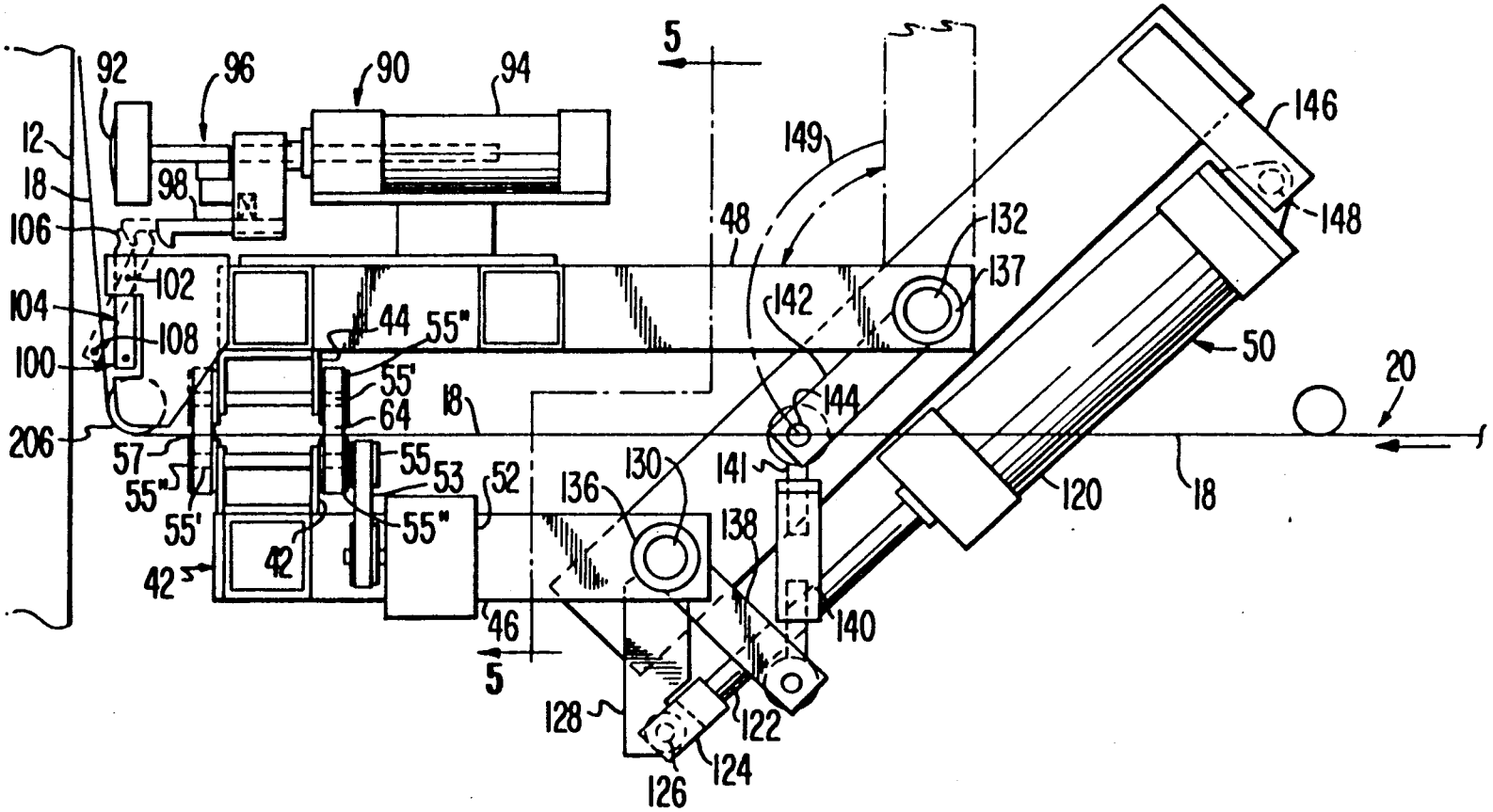
FIG. 3 illustrates a top plan view of first and second wrapping material retaining mechanisms in a second position utilized in the first embodiment of the present invention.
Figure 4:
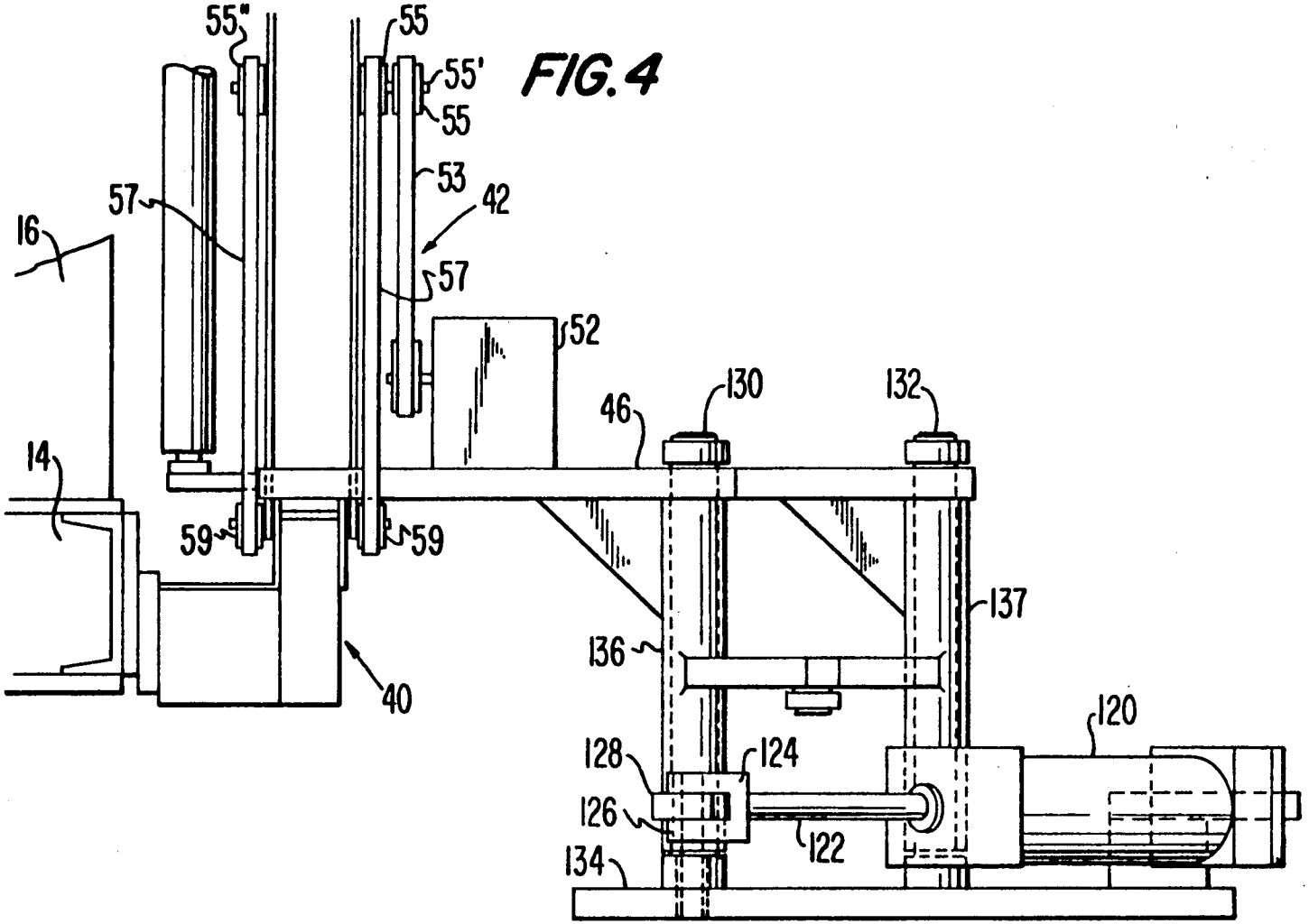
FIG. 4 is a side elevational view of FIG. 3.
Figure 5:
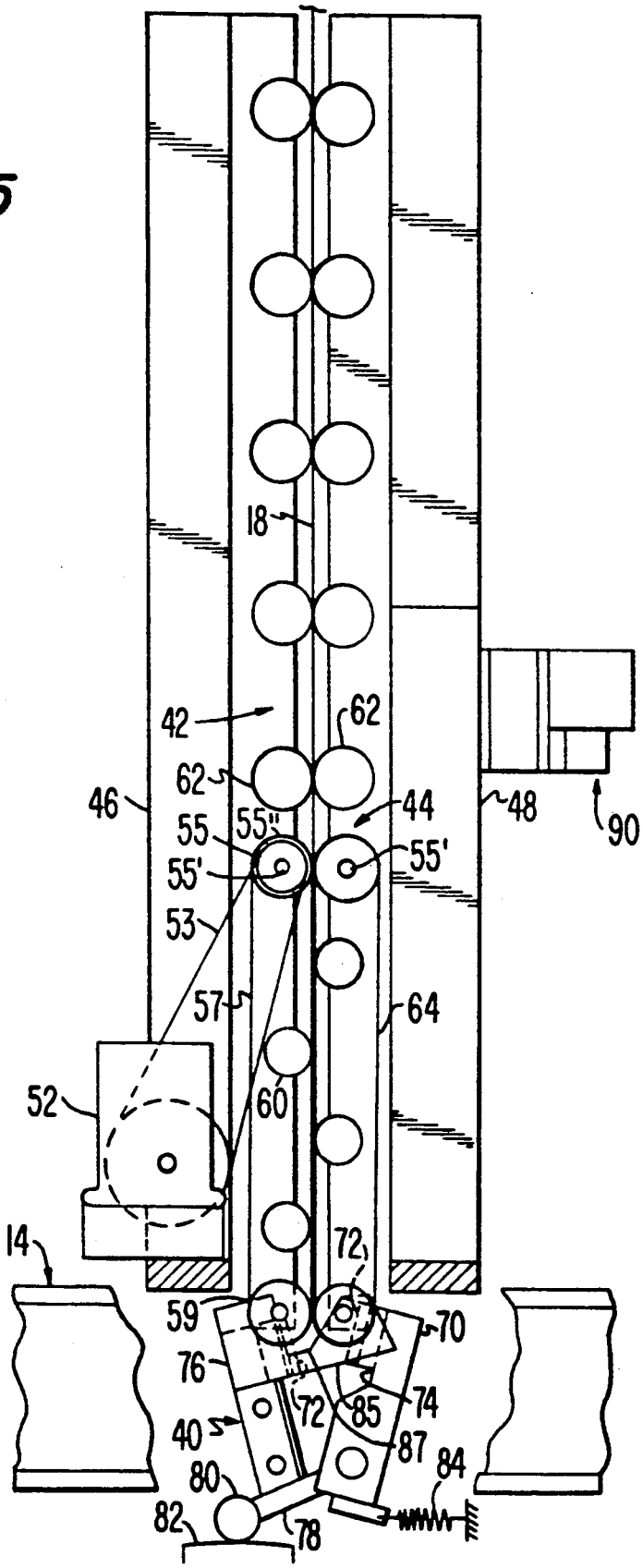
FIG. 5 is a sectional view of FIG. 3.
Figure 6:
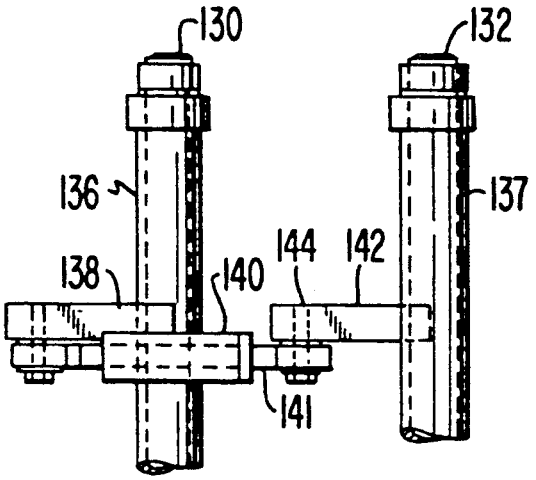
FIG. 6 is a fragmentary elevational view of the linkage assembly of the actuator.

FIGS. 3–6 illustrate, respectively, a top plan view of the first embodiment 10 illustrating in detail the first and second wrapping material retaining mechanisms 42 and 44 in the second extended position and wrapping material translating mechanism, a partial side elevation of FIG. 3, a sectional view of FIG. 3 and a fragmentary elevational view of the linkage assembly of the actuator. Like reference numerals identify like parts in FIGS. 1–6. A motor 52 supplies power by belt 53 to a pulley 55 which drives a shaft 55'. The shaft 55' drives a pair of pulleys 55''. The pulleys 55'' drive at least one driven element which may be a pair of belts 57 or a plurality of wheels (not illustrated). The pair of belts 57 are also rotatably supported by pulleys 59. One or more idler rollers 60 are disposed between the pulleys 55'' and 59 for maintaining the driven belts 57 within a plane contacting the stretchable wrapping material 18. Preferably, the spacing between the pulleys 55'' and 59 is only a fraction of the given width of the stretchable wrapping material 18. A plurality of idler rollers 62, which have an outside peripheral surface within the same plane defined by the outside surface of the driven belts 57, and an outside peripheral surface of the idler roller 60 rotatably support the translation of the stretchable wrapping material 18 downward into the clamp 40 when the motor 52 is activated to gather a fraction of or the entire width of the stretchable wrapping material. The clamp 40 is vertically aligned with the plane in which the stretchable wrapping material 18 is disposed when the first and second wrapping material retaining mechanisms are in their second position. The second wrapping material retaining mechanism 44 is identical to the first wrapping material retaining mechanism except that preferably it is not driven and at least one idler element, which preferably is a pair of idler belts 64, is driven by contact with a surface of the stretch wrapping material 18 facing the wrapping material retaining mechanism 44 during the driving of the stretchable wrapping material downward into the clamp 40 to gather it under power supplied from the motor 52. Elements of wrapping material translating mechanisms 42 and 44 also comprise the wrapping material translating mechanism which is activated by the controller activating the motor 52.

It should be understood that the number of idler rollers 62 may be varied to vary the vertical extension of the wrapping material retaining mechanisms 42 and 44 in the same plane defined by opposed surfaces of the driven belts 57 and the idler belts 64. It is possible to eliminate the idler rollers 62 by providing the driven belts 57 and the idler belts 64 with a center to center spacing of the axes of rotation equal to the given width of the stretchable wrapping material 18. Typically, the motor 52 of the wrapping material translating mechanism will be activated by the controller described below under the control of a control program to gather a fraction of the given width of the wrapping material. While the invention is not limited thereto, between 25% and 75% of the width of the stretchable wrapping material may be gathered when the given width of the stretchable wrapping material is wide, such as widths above 30 inches.

The clamp 40 may be in accordance with that disclosed in the Assignee's U.S. Pat. No. 4,563,863 and utilized in the Assignee's Model 8200CAX and 8200AX automatic stretch wrapping machines. While the invention is not limited to any particular design of clamp 40, the clamp 40 may be comprised of a first pivoted arm 70 having a rubber face 72 for retaining the gathered rope of stretchable wrapping material 18 produced by translation of the stretchable wrapping material downward by activation of the motor 52 and a fixed arm 76 also having a rubber face 72 for retaining the gathered material. The first arm 70 pivots in response to movement of member 78 between first and second positions caused by a cam follower 80 which is powered by a cam 82 which is pneumatically powered and may be under the control of a control program such as to cause the opening and closing of the arm 70 of the clamp 40. Spring 84 supplies tension for closing the arm 70 of the clamp when the cam 82 is retracted. A pair of guides 85 having a notch 87 are located outboard of the arms 70 and 76 for limiting the downward travel of the rope below the notch.

A heat sealer 90 is pneumatically actuated to move between a first retracted position as illustrated and second position at which a heated element 92 extends to push the stretchable wrapping material 18 against the load for a dwell period sufficient to heat fuse the top layer of the stretchable wrapping material to one or more underlying layers to provide a smooth non-gathered trailing edge which eliminates the possibility of the trailing gathered edge not being tightly attached to the load as in the system for attaching the trailing edge of the wrapping material in the Assignee's U.S. Pat. No. 4,563,863 and the Model 8200CAX and 8200AX automatic stretch wrapping machines. The heat sealer may be in accordance with any known design. By heat fusing the total width of the stretchable wrapping material 18 against the side of the package 12, loose ends of the trailing edge are eliminated which in the prior art such as that in the Assignee's U.S. Pat. No. 4,563,863 could erroneously trigger sensors on an automatic conveyor system or photoelectric sensors scanning the size of a load causing stoppage of wrapping as a consequence of a false indication of either the position of a load on the conveyor or an oversize load being present on the turntable. The actuation of the air cylinder 94 is under the control of the controller as described below and may be under the control of a control program. An assembly 96 carrying the heat sealer 90 also carries a latch 98 which activates a cutting mechanism 100 which is pivotally attached to the arm 48 at pivot point 102. The cutting mechanism 100 has an assembly 104 having a catch 106 which is pulled clockwise by the engagement with the latch 98 caused by movement of the assembly 96 from the extended position back to the position as illustrated causing the cutting assembly 100 to rotate outward to cut the wrapping material 18. The details of the cutting mechanism are discussed below in conjunction with FIGS. 7 and 8. Preferably, a hot wire 108 is used to cleanly severe the wrapping material 18. The clamping action provided by the first and second wrapping material retaining mechanisms 42 and 44 holds the stretchable wrapping material 18 firmly without gathering until it is translated downward by activation of motor 52 within the open clamp 52 which is thereafter closed under control of the controller as described below to retain a gathered rope of at least a fraction of the width of the wrapping material within the clamp 40. While a preferred cutting mechanism 100 contains a hot wire 108, it should be understood that the present invention is not limited thereto.

The actuator 50 is pneumatically controlled by an air cylinder 120 which is activated under the control of the controller as described below. Activation of the air cylinder 120 causes an extensible arm 122 to move between a first withdrawn position and a second extended position as illustrated. A clevis 124 is attached to the arm 122. A pin 126 extending through the clevis pivotally joins the clevis to a first member 128. A first support 130 and a second support 132 are joined to base plate 134. A sleeve 136 is rotatably supported by the first support 130 and a sleeve 137 is rotatably supported by the second support 132. The first member 128, a second member 138 and the first arm 46 are joined to the sleeve 136. The second member 138 is pivotally attached to a link 140 which is adjustable in length with a threaded length adjusting mechanism 141. The link 140 is pivotally attached to a third member 142 by pivot 144. The third member 142 is attached to the second sleeve 137. The second sleeve 137 is attached to the arm 48. A fourth member 146 is attached to the base 134 and pivots with respect to the air cylinder 120 at pivot point 148 when the air cylinder is activated to move the arm 122. The first arm 46 rotates counterclockwise and the second arm 48 rotates clockwise from the positions as illustrated to the positions illustrated in phantom in FIG. 2. Activation of the air cylinder 120 causes the aforementioned assembly carrying the arms 46 and 48 to rotate through an arc 149 to cause the rotation of the arms 46 and 48 between their first and second positions.

Figure 8:
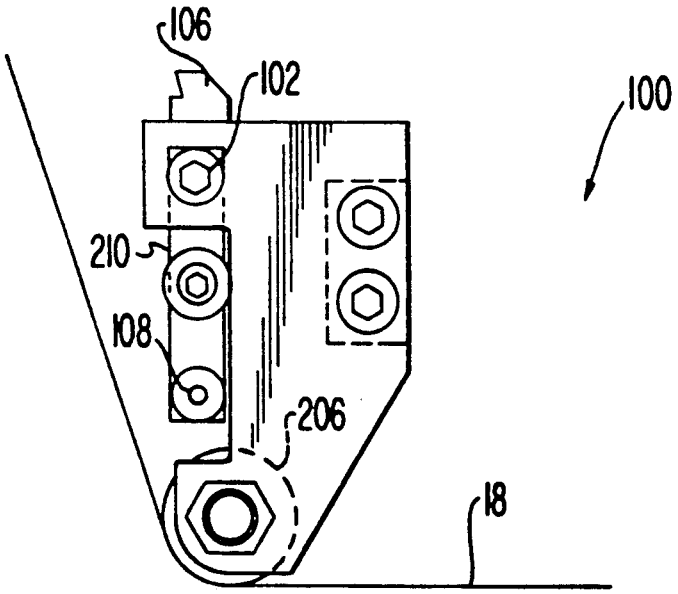
FIG. 8 illustrates a top view of the hot wire cutting mechanism of FIG. 3.
Figure 7:
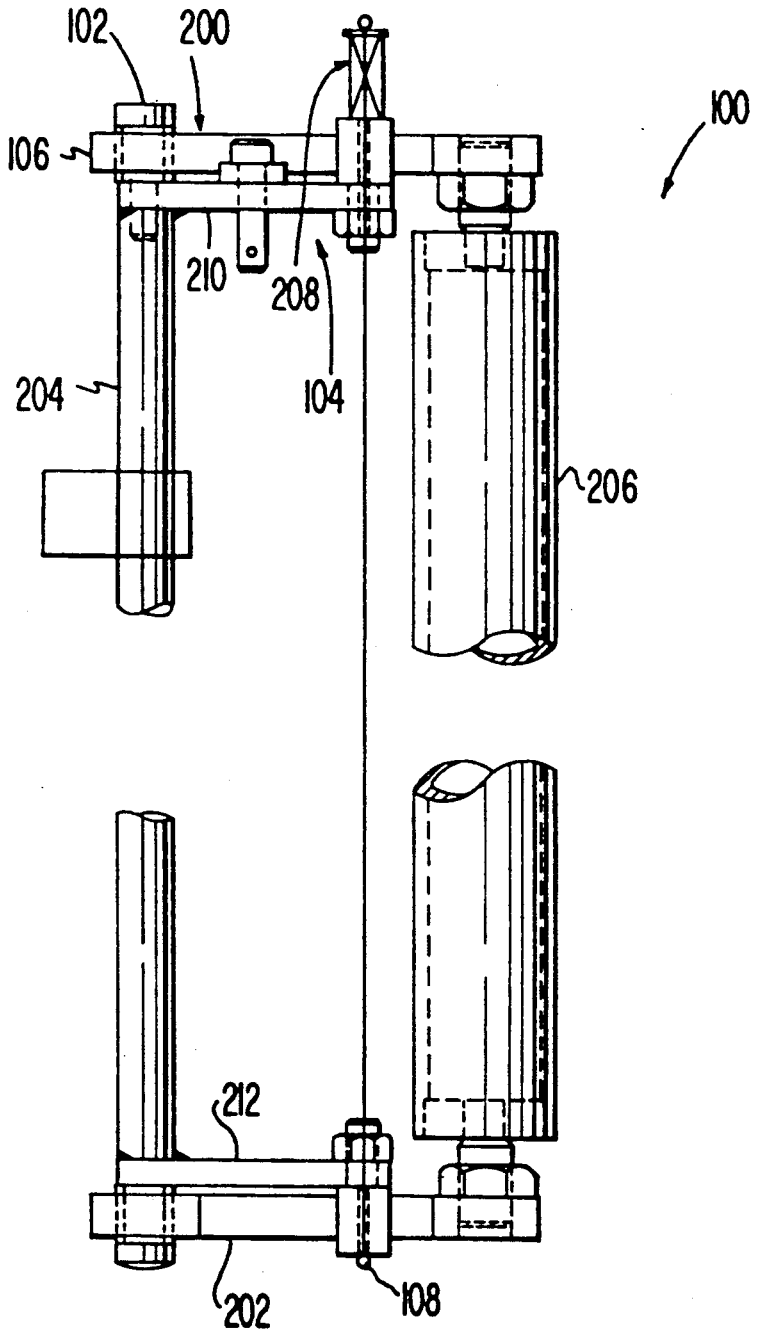
FIG. 7 illustrates a side elevational view of a hot wire cutting mechanism of FIG. 3.

FIGS. 7 and 8 respectively illustrate a side and an elevational view of the cutting mechanism 100 illustrated in FIG. 3. The cutting mechanism 100 is comprised of a pair of plates 200 and 202 which are spaced apart by rod 204 and a rotatable rubber roller 206 which rotatably supports the wrapping material 18 during the rotation of the second arm 48 to the second position and during clamping of the wrapping material by the first and second wrapping material retaining mechanisms 42 and 44. A spring 208 maintains the hot wire 108 under tension during thermal cycling to compensate for dimensional change in length. Plates 210 and 212 carry the hot wire 108. When the latch 98 of FIG. 3 is pulled from its extended position, it engages and rotates the catch 106 clockwise causing the hot wire assembly 104 to rotate clockwise to severe the wrapping material 18.

FIGS. 9–13 illustrate a wrapping sequence of wrapping a load with the first embodiment 10 of the present invention. Like reference numerals identify like parts in FIGS. 1–13. FIGS. 9–13 have been simplified to omit many of the detailed mechanical elements described above with respect to FIGS. 1–8 since their operation is not necessary for understanding the overall automatic wrapping sequence produced by the present invention. For example, the heat sealing and cutting mechanisms have been totally eliminated from FIGS. 9 and 10 and only illustrated in simplified form in FIGS. 11–13.

Figure 9:
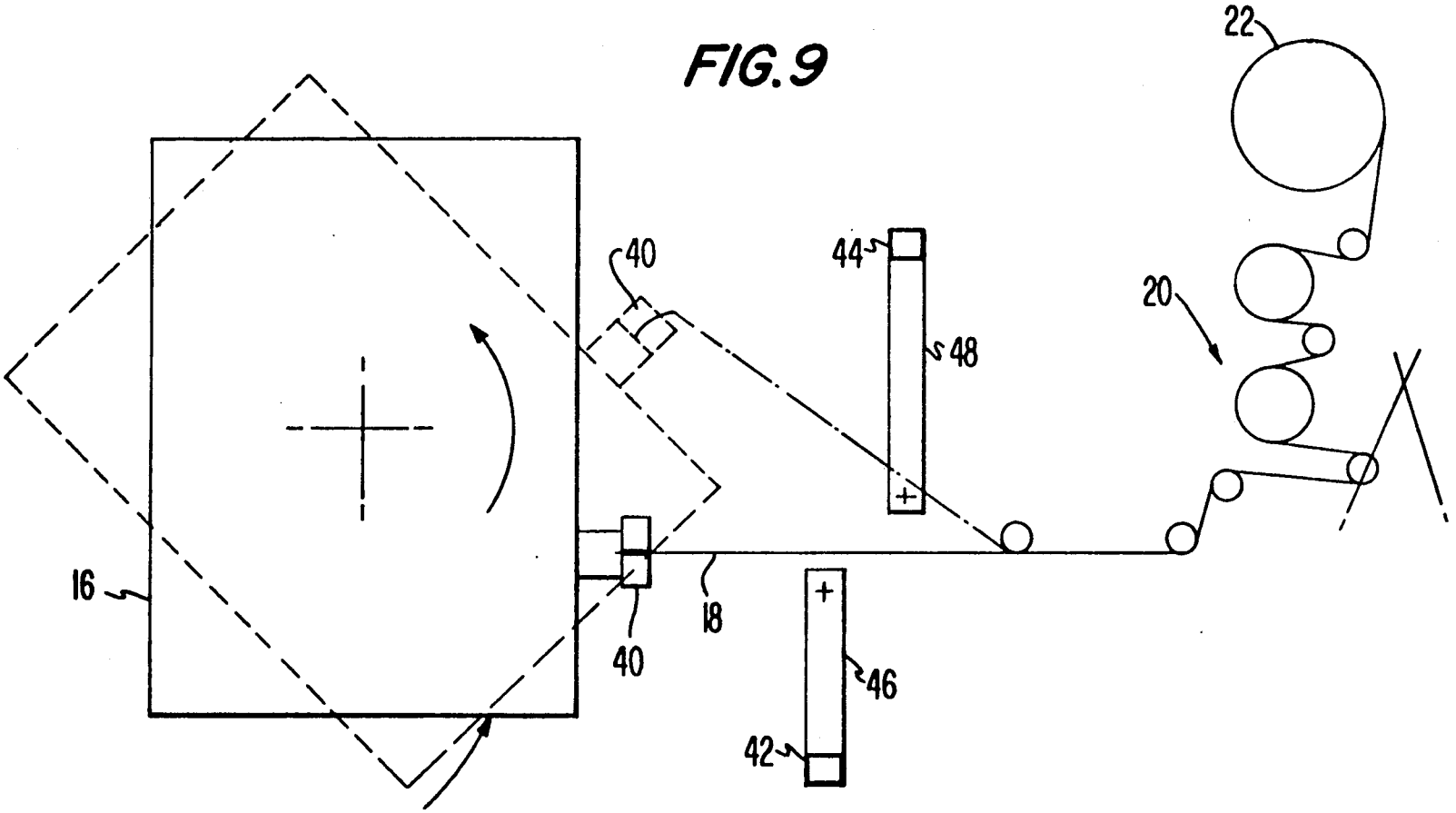
FIG. 9 illustrates initiation of the wrapping of a load with the first embodiment of the present invention.

FIG. 9 illustrates the initiation of a wrapping of a load with a stretchable wrapping material 18 in accordance with the present invention. At the beginning of the wrapping operation, the clamp 40 retains the stretchable wrapping material 18 with at least a fraction of the width of the wrapping material having been gathered and retained by the closed clamp. For wrapping loads with a high vertical profile, wrapping material from the supply 22 may have a width equal to or greater than the vertical profile of the load. In this situation, spiral wrapping is unnecessary with fewer turns of the turntable 14 being necessary to complete the wrapping of the load with a more efficient usage of the stretchable wrapping material 18 being achieved and completion of the wrapping cycle occurring in less time than with spiral wrapping. When a load 16 having a high vertical profile is wrapped, such as greater than 30 inches and up to 80 inches or more with non-spiral wrapping in which the stretchable wrapping material 18 is at least as wide as the vertical profile of the load, typically between 25% and 75% of the width of the stretchable wrapping material is gathered and held by the closed clamp 40 with the remainder of the stretchable wrapping material extending vertically upward.

Figure 10:
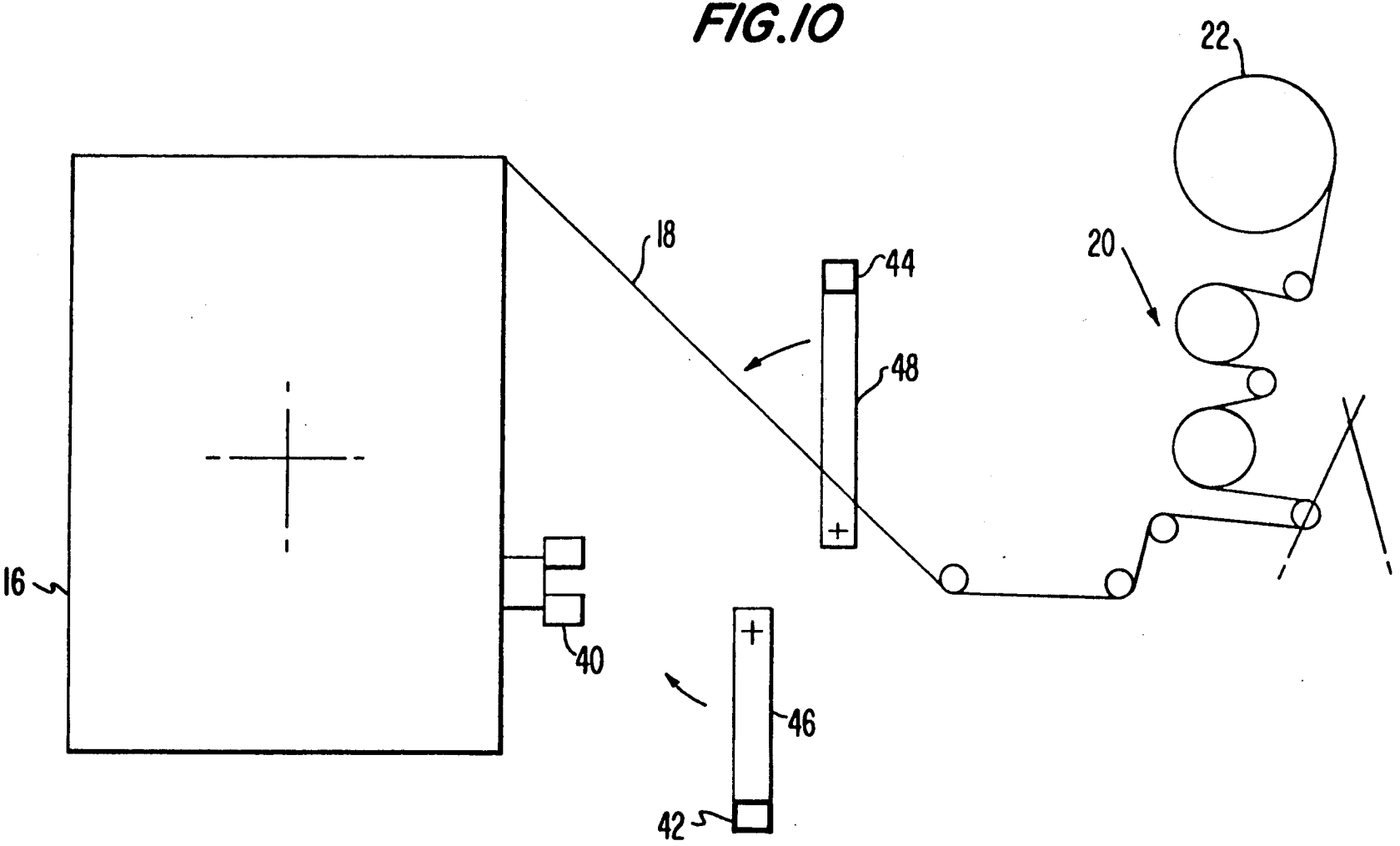
FIG. 10 illustrates the completion of the wrapping of the load with the first embodiment of the present invention.

FIG. 10 illustrates the load 16 after wrapping is completed. At the completion of wrapping, the clamp 40 is open and the stretchable wrapping material 18 retaining mechanisms 42 and 44 are positioned in their first position. At this position, the turntable is locked. Initiation of rotation of the arms 46 and 48 is started in the directions noted by the arrows toward the second position of the wrapping material retaining mechanisms as described above.

Figure 11:
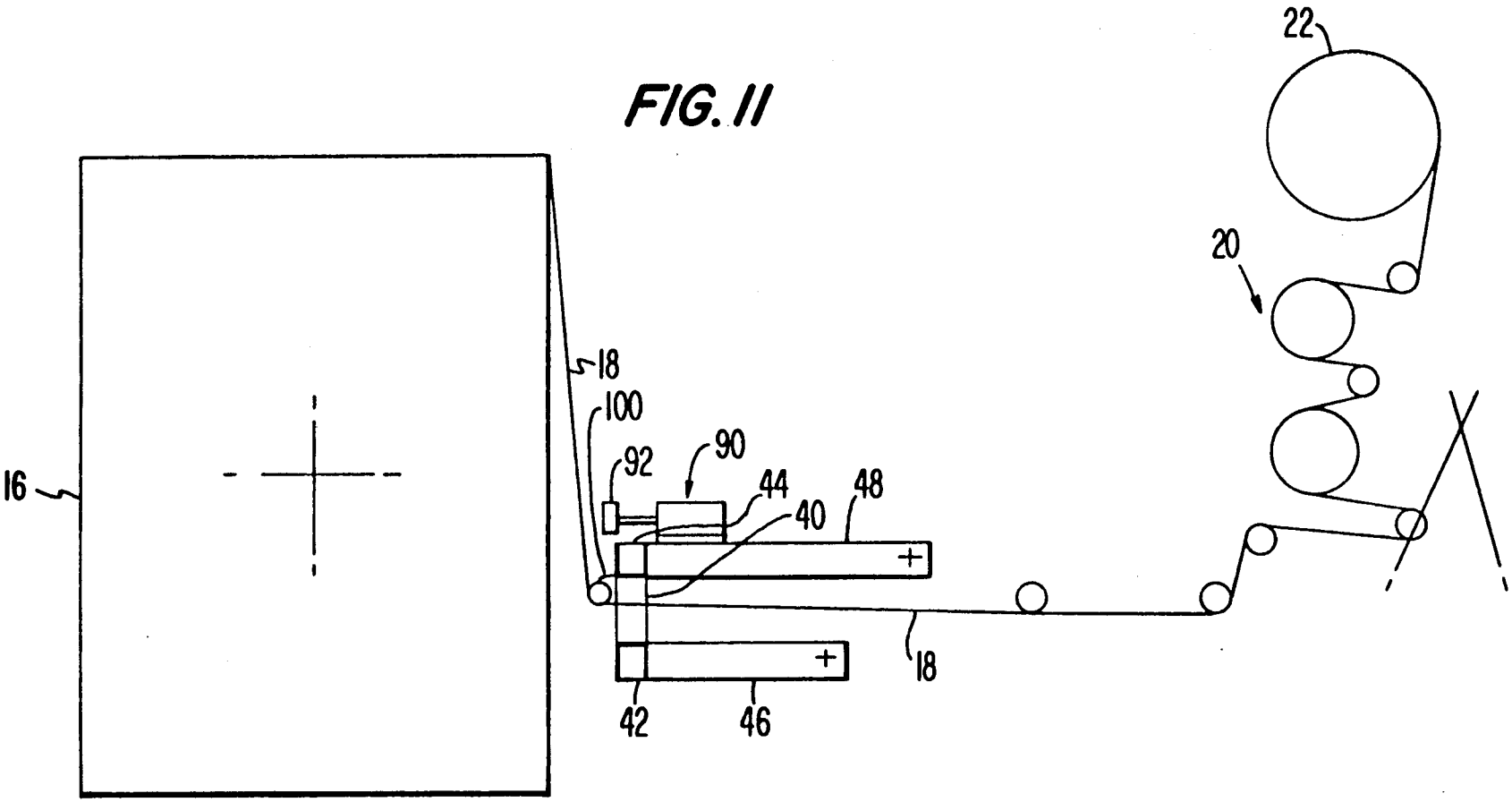
FIG. 11 illustrates the deployment of the first and second wrapping material retaining mechanisms to clamp the wrapping material without gathering and initiation of heat sealing of the trailing edge of the wrapping material to the load with the first embodiment of the invention.

FIG. 11 illustrates the wrapping of the load 10 at a point in time when the first and second wrapping material retaining mechanisms 42 and 44 have been moved to their second position to clamp the stretchable wrapping material 18 without gathering. Neither the heat sealer 90 nor the cutting assembly 100 have been activated.

Figure 12:
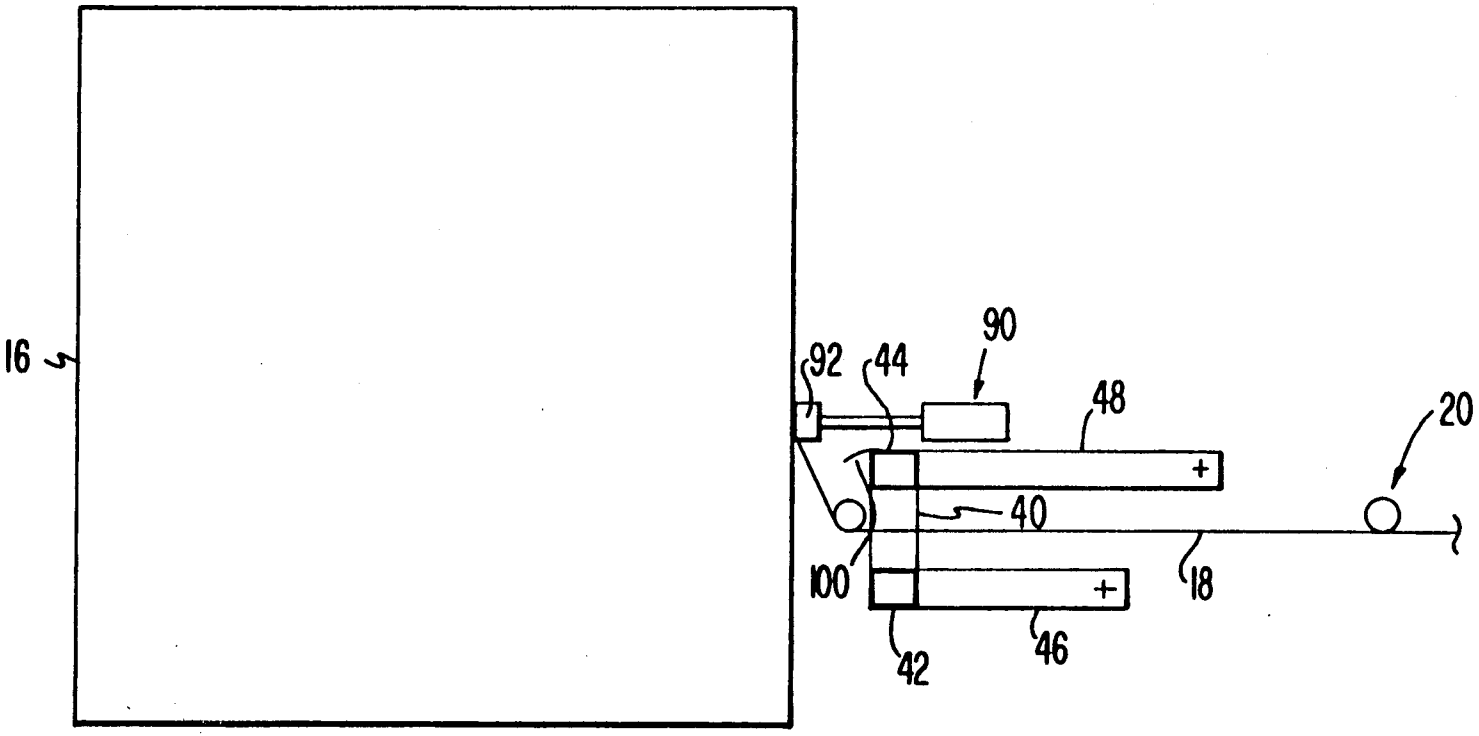
FIG. 12 illustrates the heat sealing of the trailing edge of the wrapping material to the load with the first embodiment of the invention.

FIG. 12 illustrates the wrapping of the load 16 at the time of activating the heat sealer. The stretchable wrapping material 18, which is wrapped on the load 16, is heat fused together by the heated element 92 of the heat sealer 90.

Figure 13:
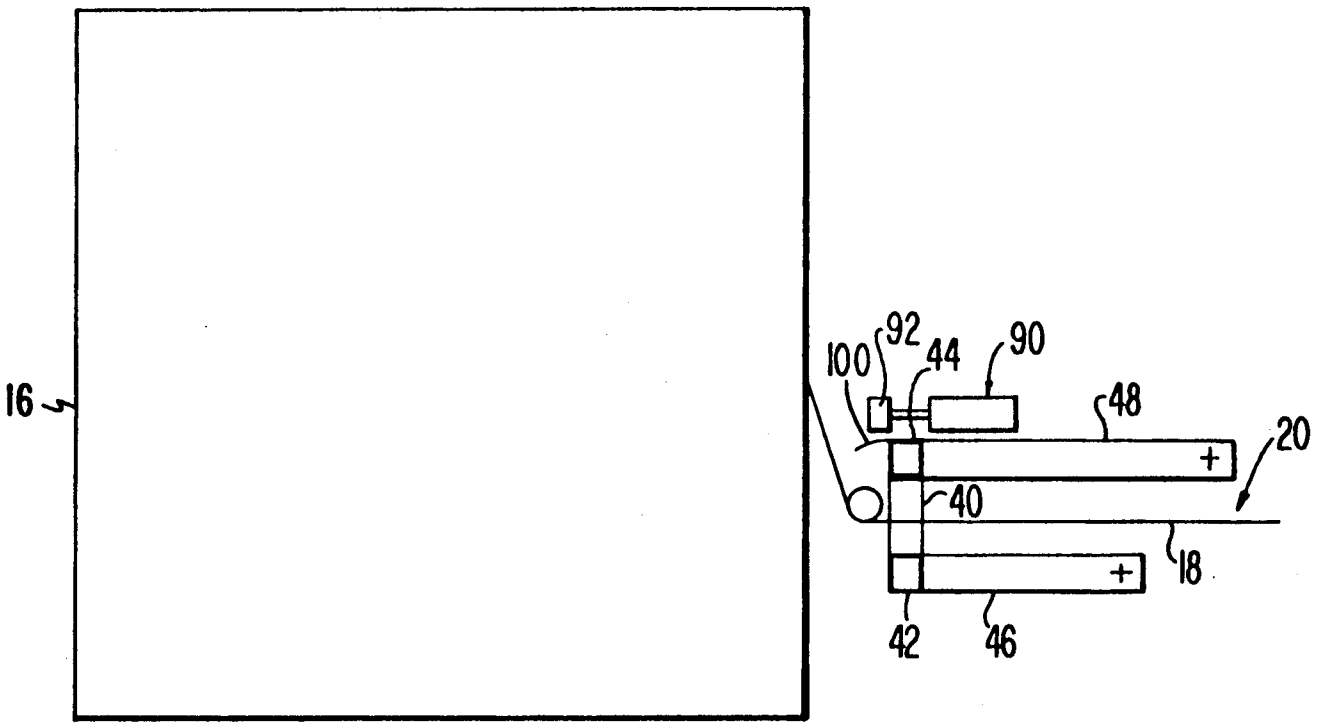
FIG. 13 illustrates the cutting of the wrapping material to severe the load from the clamped ungathered wrapping material with the first embodiment of the invention.
Figure 14:
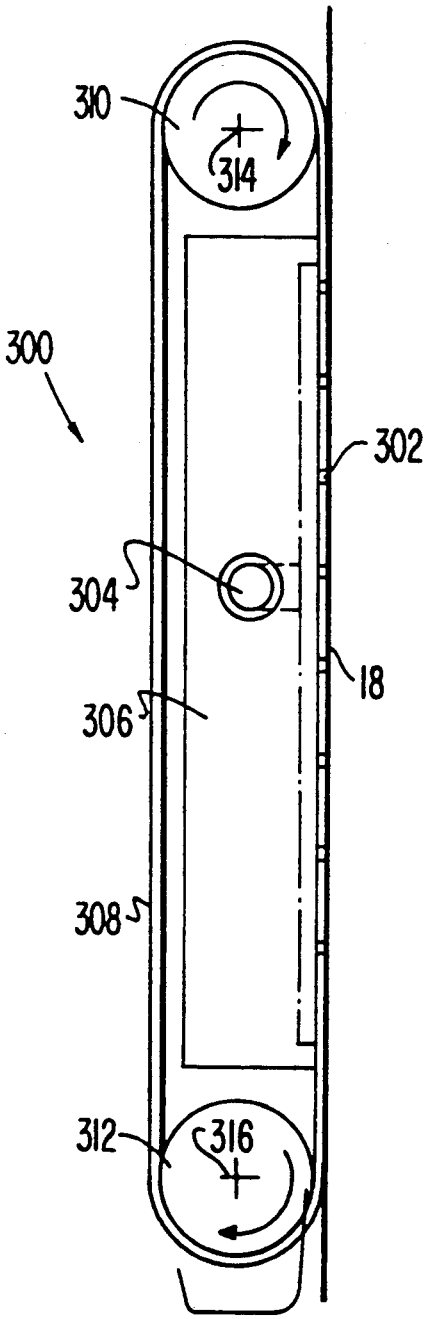
FIG. 14 illustrates a side view of a single wrapping material retaining mechanism which may be used in a second embodiment of the present invention.
Figure 15:
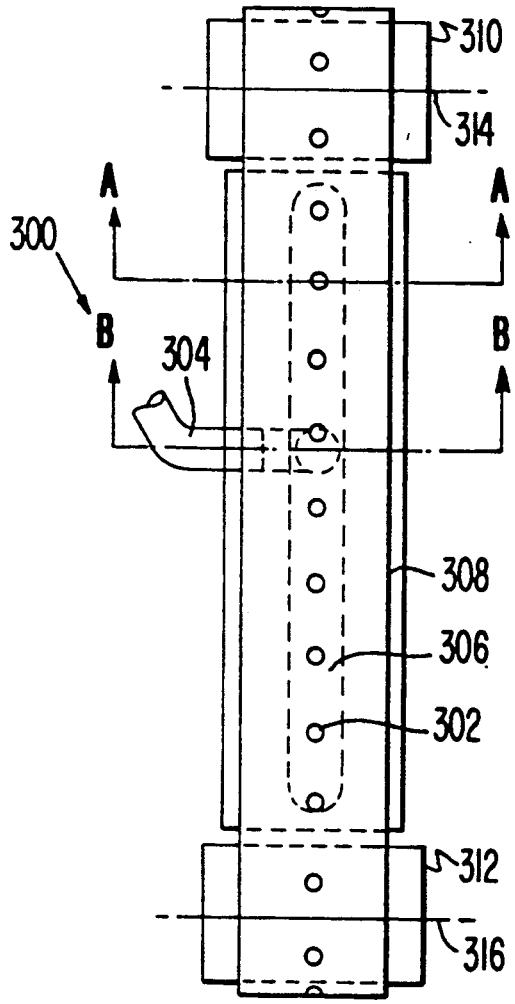
FIG. 15 illustrates a top plan view of the single wrapping material retaining mechanism of FIG. 14 viewed from the belt which contacts the wrapping material.
Figure 16:
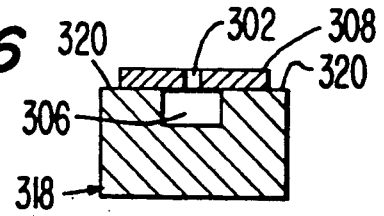
FIG. 16 is a sectional view of FIG. 14 along section line A—A.
Figure 17:
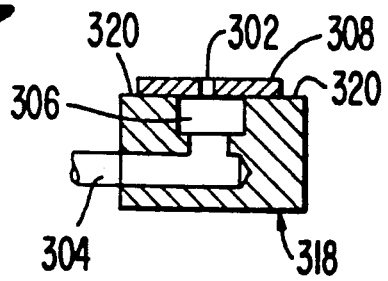
FIG. 17 is a sectional view of FIG. 14 along section B—B.

FIG. 13 illustrates the wrapping of the load 16 at the time after severing of the stretchable wrapping material 18 by the cutting mechanism 100.

FIGS. 14–17 illustrate a single wrapping material retaining mechanism 300 and mechanism for translating the stretchable wrapping material into the clamp 40 in place of the first and second wrapping material retaining mechanisms 42 and 44 and mechanism for translating the stretchable wrapping material 18 described above. The mechanism 300 is pivoted on a single arm as described below in conjunction with FIG. 18 from a first withdrawn position to a second extended position which retains the stretchable wrapping material 18 in a manner analogous to that described above. The single wrapping material retaining mechanism 300 functions as a vacuum clamp to retain a single side of the stretchable wrapping material 18 which contacts a series of apertures 302 which are connected to a vacuum source 304 by means of a vacuum plenum 306. The apertures extend throughout the length of a driven belt 308 which is rotatably supported by pulleys 310 and 312 which are spaced apart by a center to center spacing between axles 314 and 316 which is preferably equal to or greater than the width of the stretchable wrapping material 18 which is being used in order to fully clamp the total width without gathering. However, the vacuum clamp is not limited to a center to center spacing between the axles 314 and 316 which is equal to the total width of the stretchable wrapping material 18. The drive mechanism for driving the belt 308 may be identical to that described above for driving the driven belts 57. No idlers are disposed between the rollers 310 and 312 as a consequence of the cross section of the plenum 306. The plenum 306 is defined by a channel which has been machined in support member 318. The support member 318 has a pair of support surfaces 320 which extend from sidewalls of the plenum 306. The support surfaces 320 maintain the belt 308 in a plane for engaging the stretchable wrapping material 18. The vacuum applied to the plenum 306 is applied through the apertures 302 to the surface of the stretchable wrapping material contacting the surface of the belt 308 which contacts the stretchable wrapping material in a plane.

Figure 18:
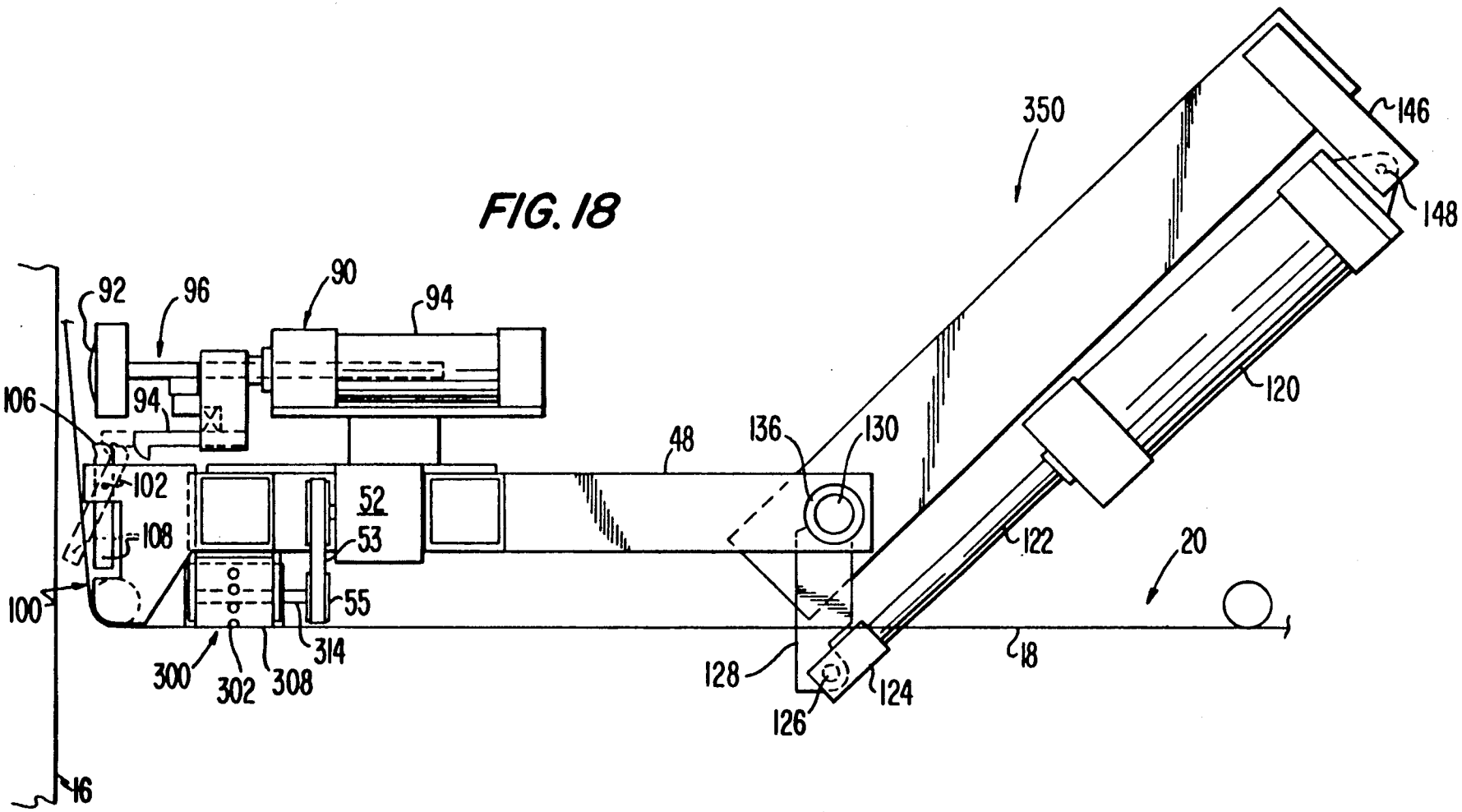
FIG. 18 is a partial top plan view of a second embodiment of the present invention illustrating the single wrapping material retaining mechanism of FIGS. 14–17 deployed in the second position.

FIG. 18 illustrates a top plan view of the single wrapping material translating mechanism 300 of FIGS. 14–17 in the second extended position and an actuator 350 for moving the single arm 48 between a first withdrawn position and a second extended position. Like reference numerals identify like parts in FIGS. 1–18. The difference between the actuator 350 and the actuator 50 described above is that the drive mechanism for the first arm 46 has been eliminated. Otherwise, the structure and operation of the actuator 350 is identical to that described above. Additionally, the single wrapping material retaining mechanism 300 has been mounted on the arm 48 in place of the wrapping material retaining mechanism 44 described above. Activation of motor 52 causes the belt drive 53 to rotate the vacuum clamp to translate the stretchable wrapping material 18 into the open clamp (not illustrated). The operation of the single arm 48 and the wrapping material retaining mechanism 300 is analogous to the sequence described above with respect to FIGS. 9–13. The only principal difference in operation with reference to FIGS. 9–13 is that the retaining of the stretchable wrapping material 18 without gathering is performed by the application of vacuum to the vacuum plenum 306 in place of the reliance on clamping the stretchable wrapping material by surface contact of the wrapping material retaining mechanism 42 and 44 to opposed sides of the stretchable wrapping material.

Figure 19:
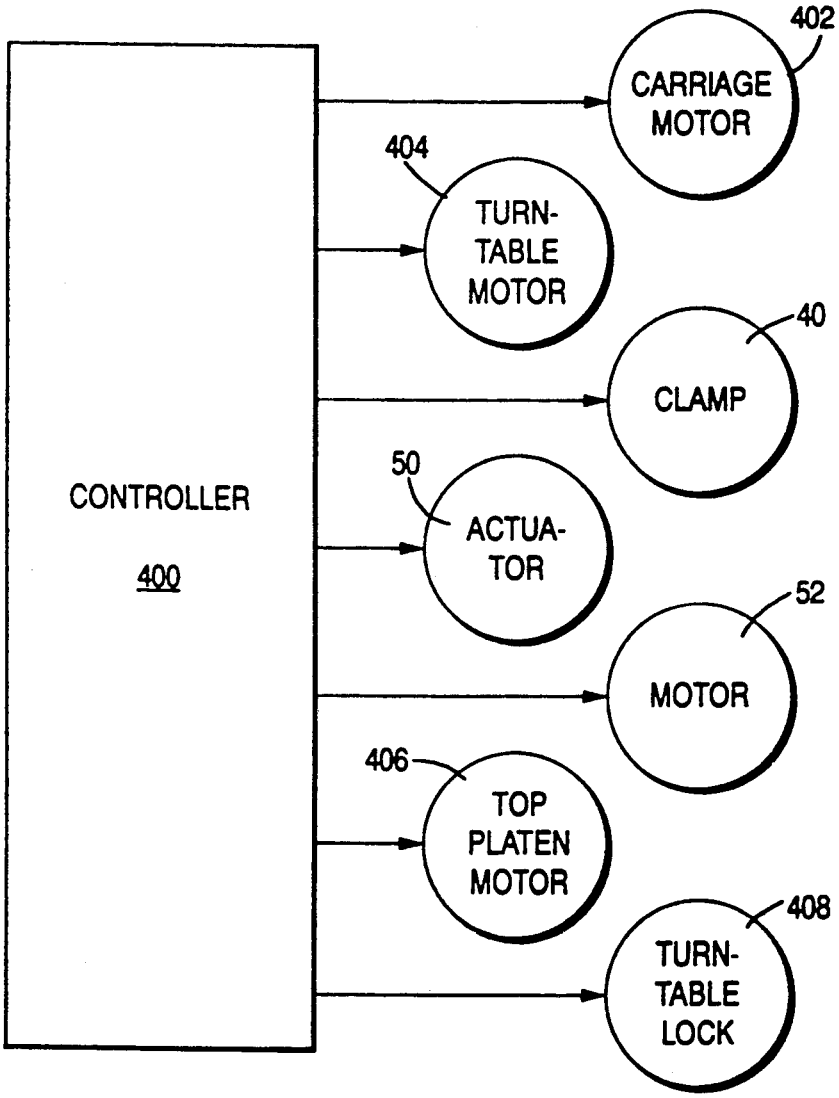
FIG. 19 is a block diagram of a controller in accordance with the present invention.

FIG. 19 illustrates a block diagram of a suitable controller for controlling the operation of an automatic stretch wrapping machine in accordance with the present invention and a method of operation. The controller 400 may be any microprocessor based system which is programmed to activate carriage motor 402, turntable motor 404, activation of the clamp 40 by pneumatic powering, activation of the actuator 50, activation of the motor 52 for translating the stretchable wrapping material 18 into the arms 70 and 76 of the clamp 40, top platen motor 406 for lowering and raising the optional top platen 38 and turntable lock 408 for locking the turntable in place during the stretch wrapping cycle. The controller 400 preferably is a controller in accordance with FIG. 20 described below. It should be understood that the present invention is not limited to the controller of FIG. 20 or the programming.

Figure 20:
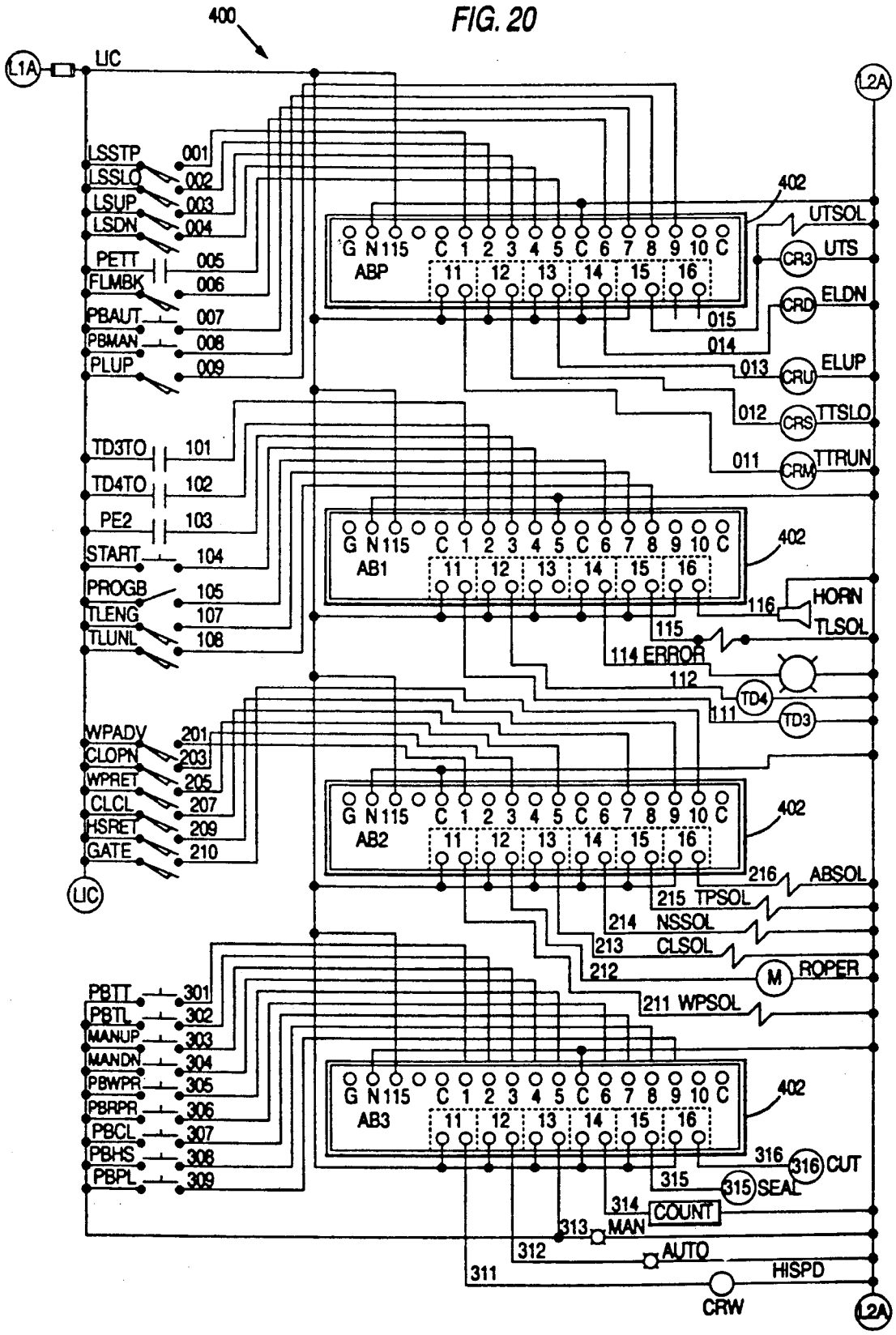
FIG. 20 is a wiring schematic of a programmed controller of the present invention.

FIG. 20 illustrates a wiring diagram of a controller 400 which may be used in practicing the invention. The individual modules 402 are SLC 100 Allen Bradley controllers. Many of the outputs from the controllers 402 are conventional and may be found within the Assignee's Model 8200CAX and 8200AX automatic stretch wrapping machines. These conventional functions do not form part of the present invention.

Figure 21:
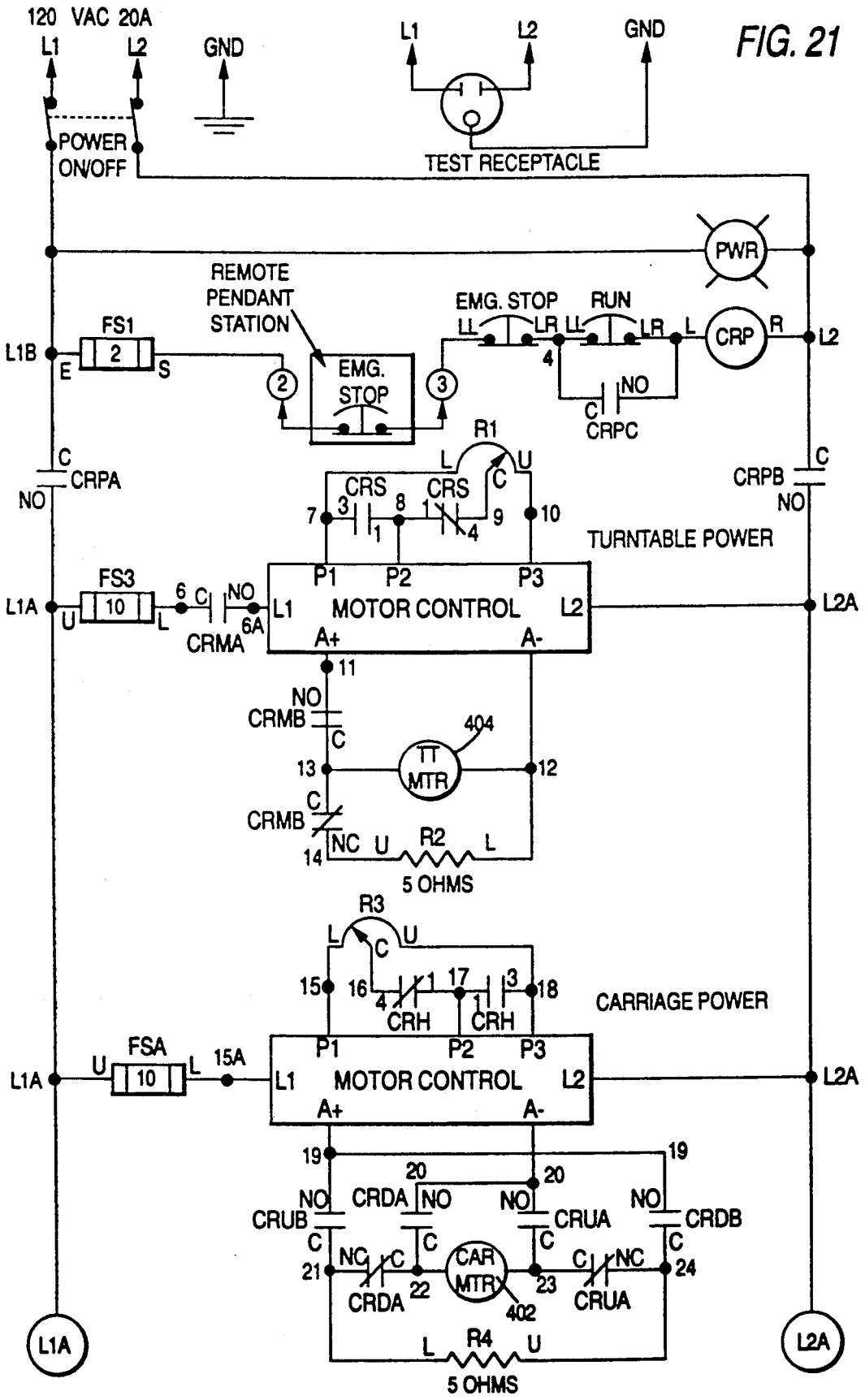
FIG. 21 is a wiring diagram of the motor control for the turntable and elevator of the film carriage of the present invention.

FIG. 21 illustrates a wiring diagram of the motor control for the turntable motor 404 and the carriage motor 402 of FIG. 19. It should be understood that the present invention is not limited to the wiring diagram of FIG. 21 with the wiring diagram being only exemplary of a mechanism for implementing the motor controls for the carriage motor 402 and turntable motor 404. A detailed explanation of the wiring diagram of FIG. 21 is not necessary for practicing the present invention.

Figure 22:
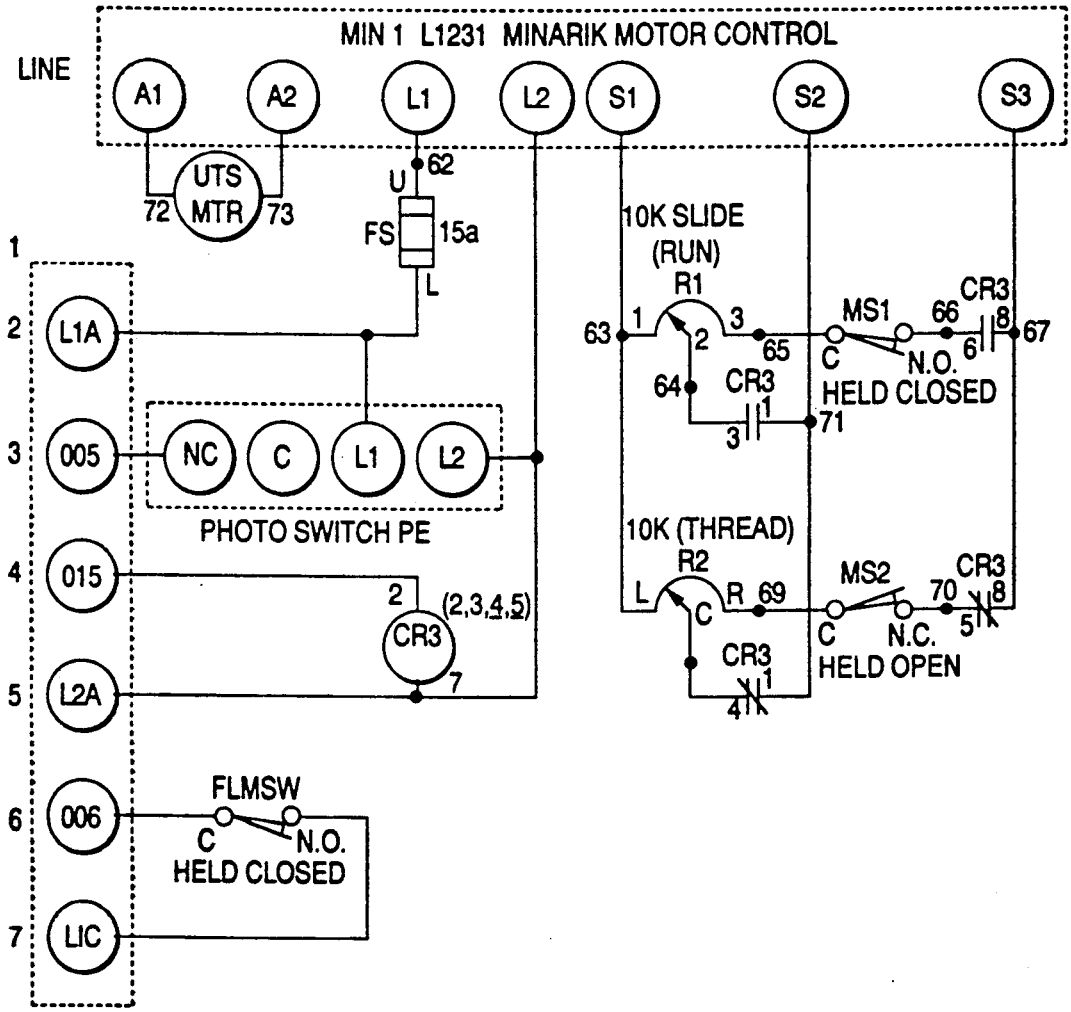
FIG. 22 is a wiring diagram of a prestretcher of the present invention.

FIG. 22 illustrates a wiring diagram for implementing the wrapping material source 20 to produce constant tension wrapping in accordance with the Assignee's U.S. Pat. Nos. 4,590,746, 4,706,443 and 4,862,678. It should be understood that the present invention is not limited to the wiring diagram of FIG. 22 with it being only exemplary of a system for controlling the supply of stretch wrapping material with constant tension for performing automatic stretch wrapping in accordance with the present invention.

A process for automatically wrapping a load 16 on a turntable 14 with a stretchable wrapping material 18 is in accordance with the operational sequence described above and is characterized by the retaining of the wrapping material in at least one wrapping material retaining mechanism 42, 44 or 300, translating the retained wrapping material into an open clamp 40 where at least a fraction of the given width of the stretchable wrapping material is roped and retained by closing the clamp to provide an effective mechanism for retaining the stretchable wrapping material during the initiation of a wrapping cycle and wrapping the load with multiple turns of wrapping material. As a consequence of the aforementioned process, stretchable wrapping materials 18 having wide widths, such as those greater than 30 inches, may be used in automatic stretch wrapping without spiral wrapping producing the improvements set forth above. Furthermore, it should be understood that the aforementioned process is not limited to the wrapping of loads in which only a fraction of the stretchable wrapping material is roped and retained within the closed clamp. The aforementioned process may be used to rope the entire width of a stretchable wrapping material such as those conventionally used having a width of 20 inches for performing either spiral or non-spiral wrapping.

While the invention has been described in terms of its preferred embodiments, it should be understood that numerous modifications may be made thereto without departing from the spirit and scope of the invention as defined in the appended claim. For example, while the preferred use of the present invention is to wrap loads with a stretchable wrapping material which is at least elastically elongated during wrapping by applied wrapping tension and may further be prestretched to inelastically elongate the material prior to wrapping and to thereafter wrap the load under tension, the present invention may be used to wrap loads with materials which are not stretchable or appreciably stretched during wrapping such as open netting. It is intended that all such modifications fall within the scope of the appended claims.

I claim:

1. An automatic wrapping machine comprising:

a turntable having a surface for rotatably supporting a load to be wrapped with a wrapping material;

means for providing wrapping material of a given width to be used to wrap a load disposed on the turntable, the load being wrapped with a section of wrapping material which is defined by a leading edge and a trailing edge;

means for rotating the turntable to cause wrapping of the load with the wrapping material under tension during wrapping;

at least one wrapping material retaining mechanism, the at least one wrapping material retaining mechanism being movable from a first position to a second position, the at least one wrapping material retaining mechanism in the second position retaining the wrapping material without gathering the wrapping material;

a clamp, aligned with the at least one wrapping material retaining mechanism in the second position, mounted for rotation with the turntable for clamping a gathered leading edge of the wrapping material during initiation of wrapping of the load to cause the wrapping material to be wrapped around the load without slippage as the turntable rotates and for clamping gathered wrapping material which becomes the gathered leading edge for wrapping a next load;

a mechanism for opening and closing the clamp;

a cutting mechanism for cutting the wrapping material;

a wrapping material translating mechanism carried by one of the at least one wrapping material retaining mechanism for translating the wrapping material retained by the at least one wrapping material retaining mechanism into the opened clamp to gather a portion of the wrapping material within the clamp for clamping when the clamp is closed; and a controller causing sequentially in time wrapping the load by activating the means for rotating the turntable and the means for providing wrapping material, the at least one wrapping material retaining mechanism to move to the second position to retain the wrapping material, activation of the cutting mechanism to cut the wrapping material to free the wrapping material from the load, activation of the wrapping material translating mechanism to translate the portion of the wrapping material into the clamp, closing the clamp to retain gathered wrapping material in the clamp to gather the portion of the material while leaving a remainder of the material not gathered and moving the at least one wrapping material holding mechanism to the first position.

2. An automatic wrapping machine in accordance with claim 1 wherein:

first and second wrapping material retaining mechanisms retain the wrapping material at the second position.

3. An automatic wrapping machine in accordance with claim 1 wherein:

one wrapping material retaining mechanism retains the wrapping material at the second position.

4. An automatic wrapping machine in accordance with claim 2 wherein:

the first and second wrapping material retaining mechanisms retain the wrapping material in the second position by contacting two sides of the wrapping material at opposed positions of the two sides of the wrapping material to clamp the wrapping material.

5. An automatic wrapping machine in accordance with claim 3 wherein:

the one wrapping material retaining mechanism retains the wrapping material at the second position by a vacuum clamp.

6. An automatic wrapping machine in accordance with claim 5 wherein the vacuum clamp comprises:

a belt having a plurality of apertures with a first side of the belt retaining the wrapping material when the one wrapping material retaining mechanism is in the second position;

a vacuum plenum facing a second side of the belt;

a vacuum source for applying vacuum to the plenum which is applied to the wrapping material through the apertures; and a motor for driving the belt to translate the retained wrapping material into the open clamp.

7. An automatic wrapping machine in accordance with claim 4 wherein:

the first wrapping material retaining mechanism has at least one driven element contacting the wrapping material across at least a fraction of the given width when the first wrapping material retaining mechanism is in the second position;

the second wrapping material retaining mechanism has at least one idler contacting the wrapping material across at least a fraction of the given width when the second wrapping material retaining mechanism is in the second position; and a motor for driving the at least one driven element which translates the wrapping material into the open clamp with the idler being driven by the translation of the wrapping material into the open clamp.

8. An automatic wrapping machine in accordance with claim 7 wherein:

the first wrapping material retaining mechanism further comprises at least one idler roller in line with a direction of motion of the at least one driven element with the at least one idler roller each having a peripheral surface contacting the wrapping material when the first wrapping material retaining mechanism is in the second position and disposed within a plane containing a surface of the at least one driven element contacting the wrapping material; and the second wrapping material retaining mechanism further comprises at least one idler roller in line with a direction of motion of the at least one idler with the at least one idler roller each having a peripheral surface contacting the wrapping material when the second wrapping material retaining mechanism is in the second position and disposed within a plane containing a surface of the at least one idler contacting the wrapping material.

9. An automatic wrapping machine in accordance with claim 2 wherein:

the first and second wrapping material retaining mechanisms are respectively mounted on first and second arms which rotate between first and second positions to move the first and second wrapping material retaining mechanisms between the first and second positions.

10. An automatic wrapping machine in accordance with claim 9 further comprising:

an actuator which is movable between first and second positions under control of the controller for driving the arms between the first and second positions.

11. An automatic wrapping machine in accordance with claim 3 wherein:

the one wrapping material retaining mechanism is mounted on an arm which rotates between first and second positions to move the one wrapping material retaining mechanism between the first and second positions.

12. An automatic wrapping machine in accordance with claim 11 further comprising:

an actuator which is movable between first and second positions under control of the controller for driving the arm between the first and second position.

13. An automatic wrapping machine in accordance with claim 1 wherein:

the controller controls the wrapping material translating mechanism to cause movement of the wrapping material by a distance, equal to a fraction of the given width, into the open clamping mechanism to gather a fraction of the given width in the clamp.

14. An automatic wrapping machine in accordance with claim 13 wherein:

the gathered fraction is equal to between 25% and 75% of the given width.

15. An automatic wrapping machine in accordance with claim 2 wherein:

the controller controls the wrapping material translating mechanism to cause movement of the wrapping material by a distance, equal to a fraction of the given width, into the open clamping mechanism to gather a fraction of the given width in the clamp.

16. An automatic wrapping machine in accordance with claim 3 wherein:

the controller controls the wrapping material translating mechanism to cause movement of the wrapping material by a distance, equal to a fraction of the given width, into the open clamping mechanism to gather a fraction of the given width in the clamp.

17. An automatic wrapping machine in accordance with claim 4 wherein:

the controller controls the wrapping material translating mechanism to cause movement of the wrapping material by a distance, equal to a fraction of the given width, into the open clamping mechanism to gather a fraction of the given width in the clamp.

18. An automatic wrapping machine in accordance with claim 5 wherein:

the controller controls the wrapping material translating mechanism to cause movement of the wrapping material by a distance, equal to a fraction of the given width, into the open clamping mechanism to gather a fraction of the given width in the clamp.

19. An automatic wrapping machine in accordance with claim 6 wherein:

the controller controls the wrapping material translating mechanism to cause movement of the wrapping material by a distance, equal to a fraction of the given width, into the open clamping mechanism to gather a fraction of the given width in the clamp.

20. An automatic wrapping machine in accordance with claim 7 wherein:

the controller controls the wrapping material translating mechanism to cause movement of the wrapping material by a distance, equal to a fraction of the given width, into the open clamping mechanism to gather a fraction of the given width in the clamp.

21. An automatic wrapping machine in accordance with claim 8 wherein:

the controller controls the wrapping material translating mechanism to cause movement of the wrapping material by a distance, equal to a fraction of the given width, into the open clamping mechanism to gather a fraction of the given width in the clamp.

22. An automatic wrapping machine in accordance with claim 9 wherein:

the controller controls the wrapping material translating mechanism to cause movement of the wrapping material by a distance, equal to a fraction of the given width, into the open clamping mechanism to gather a fraction of the given width in the clamp.

23. An automatic wrapping machine in accordance with claim 10 wherein:

the controller controls the wrapping material translating mechanism to cause movement of the wrapping material by a distance, equal to a fraction of the given width, into the open clamping mechanism to gather a fraction of the given width in the clamp.

24. An automatic wrapping machine in accordance with claim 11 wherein:

the controller controls the wrapping material translating mechanism to cause movement of the wrapping material by a distance, equal to a fraction of the given width, into the open clamping mechanism to gather a fraction of the given width in the clamp.

25. An automatic wrapping machine in accordance with claim 12 wherein:

the controller controls the wrapping material translating mechanism to cause movement of the wrapping material by a distance, equal to a fraction of the given width, into the open clamping mechanism to gather a fraction of the given width in the clamp.

26. In a wrapping machine which retains a gathered leading edge of a wrapping material with a clamp carried by a rotatable turntable supporting a load during at least initiation of wrapping of the load with the wrapping material an improvement comprising:

at least one wrapping material retaining mechanism, the at least one wrapping material retaining mechanism being movable from a first position to a second position, the at least one wrapping material retaining mechanism in the second position retaining the wrapping material without gathering of the wrapping material;

a wrapping material translating mechanism carried by one of the at least one wrapping material retaining mechanism for translating the wrapping material retained by the at least one wrapping material retaining mechanism into the opened clamped to gather a portion of the wrapping material within the clamp when the clamp is in an open position for retention of the gathered wrapping material when the clamp is closed; and a controller for controlling the movement of the at least one wrapping material retaining mechanism between the first and second positions, the wrapping material translating mechanism to translate the portion of the wrapping material into the open clamp to gather the portion of the material while leaving a remainder of the material not gathered and the closing of the clamp to retain the gathered wrapping material.

27. An automatic wrapping machine in accordance with claim 26 wherein:

first and second wrapping material retaining mechanisms retain the wrapping material at the second extended position.

28. An automatic wrapping machine in accordance with claim 26 wherein:

one wrapping material retaining mechanism retains the wrapping material at the second extended position.

29. An automatic wrapping machine in accordance with claim 27 wherein:

the first and second wrapping material retaining mechanisms retain the wrapping material in the second extended position by contacting two sides of the wrapping material at opposed positions of two sides of the wrapping material to clamp the wrapping material.

30. An automatic wrapping machine in accordance with claim 28 wherein:

the one wrapping material retaining mechanism retains the wrapping material at the second position by a vacuum clamp.

31. An automatic wrapping machine in accordance with claim 30 wherein the vacuum clamp comprises:

a belt having a plurality of apertures with a first side of the belt retaining the wrapping material when the one wrapping material retaining mechanism is in the second position;

a vacuum plenum facing a second side of the belt;

a vacuum source for applying vacuum to the plenum which is applied to the wrapping material through the apertures; and a motor for driving the belt to translate the retained wrapping material into the open clamp.

32. An automatic wrapping machine in accordance with claim 29 wherein:

the first wrapping material retaining mechanism has at least one driven element contacting the wrapping material across at least a fraction of the given width when the first wrapping material retaining mechanism is in the second position;

the second wrapping material retaining mechanism has at least one idler contacting the wrapping material across at least a fraction of the given width when the second wrapping material retaining mechanism is in the second position; and a motor for driving the at least one driven element which translates the wrapping material into the open clamp with the idler being driven by the translation of the wrapping material into the open clamp.

33. An automatic wrapping machine in accordance with claim 32 wherein:

the first wrapping material retaining mechanism further comprises at least one idler roller in line with a direction of motion of the at least one driven element with the at least one idler roller each having a peripheral surface contacting the wrapping material when the first wrapping material retaining mechanism is in the second position and disposed within a plane containing a surface of the at least one driven element contacting the wrapping material; and the second wrapping material retaining mechanism further comprises at least one idler roller in line with a direction of motion of the at least one idler with the at least one idler roller each having a peripheral surface contacting the wrapping material when the second wrapping material retaining mechanism is in the second position and disposed within a plane containing a surface of the at least one idler contacting the wrapping material.

34. An automatic wrapping machine in accordance with claim 27 wherein:

the first and second wrapping material retaining mechanisms are respectively mounted on first and second arms which rotate between first and second positions to move the first and second wrapping material retaining mechanism between the first and second positions.

35. An automatic wrapping machine in accordance with claim 34 further comprising:

an actuator which is movable between first and second positions under control of the controller for driving the arms between the first and second positions.

36. An automatic wrapping machine in accordance with claim 28 wherein:

the one wrapping material retaining mechanism is mounted on an arm which rotates between first and second positions to move the one wrapping material retaining mechanism between the first and second positions.

37. An automatic wrapping machine in accordance with claim 36 further comprising:

an actuator which is movable between first and second positions under control of the controller for driving the arm between the first and second positions.

38. An automatic wrapping machine in accordance with claim 36 wherein:

the controller controls the wrapping material translating mechanism to cause movement of the wrapping material by a distance, equal to a fraction of the given width, into the open clamp to gather a fraction of the given width in the clamp.

39. An automatic wrapping machine in accordance with claim 27 wherein:

the controller controls the wrapping material translating mechanism to cause movement of the wrapping material by a distance, equal to a fraction of the given width, into the open clamp to gather a fraction of the given width in the clamp.

40. An automatic wrapping machine in accordance with claim 28 wherein:

the controller controls the wrapping material translating mechanism to cause movement of the wrapping material by a distance, equal to a fraction of the given width, into the open clamp to gather a fraction of the given width in the clamp.

41. An automatic wrapping machine in accordance with claim 29 wherein:

the controller controls the wrapping material translating mechanism to cause movement of the wrapping material by a distance, equal to a fraction of the given width, into the open clamp to gather a fraction of the given width in the clamp.

42. An automatic wrapping machine in accordance with claim 30 wherein:

the controller controls the wrapping material translating mechanism to cause movement of the wrapping material by a distance, equal to a fraction of the given width, into the open clamp to gather a fraction of the given width in the clamp.

43. An automatic wrapping machine in accordance with claim 31 wherein:

the controller controls the wrapping material translating mechanism to cause movement of the wrapping material by a distance, equal to a fraction of the given width, into the open clamp to gather a fraction of the given width in the clamp.

44. An automatic wrapping machine in accordance with claim 32 wherein:

the controller controls the wrapping material translating mechanism to cause movement of the wrapping material by a distance, equal to a fraction of the given width, into the open clamp to gather a fraction of the given width in the clamp.

45. An automatic wrapping machine in accordance with claim 33 wherein:

the controller controls the wrapping material translating mechanism to cause movement of the wrapping material by a distance, equal to a fraction of the given width, into the open clamp to gather a fraction of the given width in the clamp.

46. An automatic wrapping machine in accordance with claim 34 wherein:

the controller controls the wrapping material translating mechanism to cause movement of the wrapping material by a distance, equal to a fraction of the given width, into the open clamp to gather a fraction of the given width in the clamp.

47. An automatic wrapping machine in accordance with claim 35 wherein:

the controller controls the wrapping material translating mechanism to cause movement of the wrapping material by a distance, equal to a fraction of the given width, into the open clamp to gather a fraction of the given width in the clamp.

48. An automatic wrapping machine in accordance with claim 36 wherein:

the one wrapping material retaining mechanism is mounted on an arm which rotates between first and second positions to move the one wrapping material retaining mechanism between the first and second positions.

49. An automatic wrapping machine in accordance with claim 37 wherein:

the controller controls the wrapping material translating mechanism to cause movement of the wrapping material by a distance, equal to a fraction of the given width, into the open clamp to gather a fraction of the given width in the clamp.

50. An automatic wrapping machine in accordance with claim 1 wherein:

the given width of the wrapping material is at least as wide as the load; and the controller causes the means for providing wrapping material and the means for rotating the turntable to wrap the load with multiple turns of wrapping material at least as wide as the load.

51. An automatic wrapping machine in accordance with claim 2 wherein:

the given width of the wrapping material is at least as wide as the load; and the controller causes the means for providing wrapping material and the means for rotating the turntable to wrap the load with multiple turns of wrapping material at least as wide as the load.

52. An automatic wrapping machine in accordance with claim 3 wherein:

the given width of the wrapping material is at least as wide as the load; and the controller causes the means for providing wrapping material and the means for rotating the turntable to wrap the load with multiple turns of wrapping material at least as wide as the load.

53. An automatic wrapping machine in accordance with claim 4 wherein:

the given width of the wrapping material is at least as wide as the load; and the controller causes the means for providing wrapping material and the means for rotating the turntable to wrap the load with multiple turns of wrapping material at least as wide as the load.

54. An automatic wrapping machine in accordance with claim 5 wherein:

the given width of the wrapping material is at least as wide as the load; and the controller causes the means for providing wrapping material and the means for rotating the turntable to wrap the load with multiple turns of wrapping material at least as wide as the load.

55. An automatic wrapping machine in accordance with claim 13 wherein:

the given width of the wrapping material is at least as wide as the load; and the controller causes the means for providing wrapping material and the means for rotating the turntable to wrap the load with multiple turns of wrapping material at least as wide as the load.

56. An automatic wrapping machine in accordance with claim 15 wherein:

the given width of the wrapping material is at least as wide as the load; and the controller causes the means for providing wrapping material and the means for rotating the turntable to wrap the load with multiple turns of wrapping material at least as wide as the load.

57. An automatic wrapping machine in accordance with claim 16 wherein:

the given width of the wrapping material is at least as wide as the load; and the controller causes the means for providing wrapping material and the means for rotating the turntable to wrap the load with multiple turns of wrapping material at least as wide as the load.

58. An automatic wrapping machine in accordance with claim 17 wherein:

the given width of the wrapping material is at least as wide as the load; and the controller causes the means for providing wrapping material and the means for rotating the turntable to wrap the load with multiple turns of wrapping material at least as wide as the load.

59. An automatic wrapping machine in accordance with claim 18 wherein:

the given width of the wrapping material is at least as wide as the load; and the controller causes the means for providing wrapping material and the means for rotating the turntable to wrap the load with multiple turns of wrapping material at least as wide as the load.

60. An automatic wrapping machine in accordance with claim 26 wherein:

the given width of the wrapping material is at least as wide as the load; and the controller causes the means for providing wrapping material and the means for rotating the turntable to wrap the load with multiple turns of wrapping material at least as wide as the load.

61. An automatic wrapping machine in accordance with claim 27 wherein:

the given width of the wrapping material is at least as wide as the load; and the controller causes the means for providing wrapping material and the means for rotating the turntable to wrap the load with multiple turns of wrapping material at least as wide as the load.

62. An automatic wrapping machine in accordance with claim 28 wherein:

the given width of the wrapping material is at least as wide as the load; and the controller causes the means for providing wrapping material and the means for rotating the turntable to wrap the load with multiple turns of wrapping material at least as wide as the load.

63. An automatic wrapping machine in accordance with claim 29 wherein:

the given width of the wrapping material is at least as wide as the load; and the controller causes the means for providing wrapping material and the means for rotating the turntable to wrap the load with multiple turns of wrapping material at least as wide as the load.

64. An automatic wrapping machine in accordance with claim 30 wherein:

the given width of the wrapping material is at least as wide as the load; and the controller causes the means for providing wrapping material and the means for rotating the turntable to wrap the load with multiple turns of wrapping material at least as wide as the load.

65. An automatic wrapping machine in accordance with claim 38 wherein:

the given width of the wrapping material is at least as wide as the load; and the controller causes the means for providing wrapping material and the means for rotating the turntable to wrap the load with multiple turns of wrapping material at least as wide as the load.

66. An automatic wrapping machine in accordance with claim 39 wherein:

the given width of the wrapping material is at least as wide as the load; and the controller causes the means for providing wrapping material and the means for rotating the turntable to wrap the load with multiple turns of wrapping material at least as wide as the load.

67. An automatic wrapping machine in accordance with claim 40 wherein:

the given width of the wrapping material is at least as wide as the load; and the controller causes the means for providing wrapping material and the means for rotating the turntable to wrap the load with multiple turns of wrapping material at least as wide as the load.

68. An automatic wrapping machine in accordance with claim 41 wherein:

the given width of the wrapping material is at least as wide as the load; and the controller causes the means for providing wrapping material and the means for rotating the turntable to wrap the load with multiple turns of wrapping material at least as wide as the load.

69. An automatic wrapping machine in accordance with claim 43 wherein:

the given width of the wrapping material is at least as wide as the load; and the controller causes the means for providing wrapping material and the means for rotating the turntable to wrap the load with multiple turns of wrapping material at least as wide as the load.

70. An automatic wrapping machine in accordance with claim 7 wherein:

the at least one driven element is at least one driven belt and the at least one idler is at least one belt.

71. An automatic wrapping machine in accordance with claim 32 wherein:

the at least one driven element is at least one driven belt and the at least one idler is at least one belt.

* * * * *